US008276332B2

(12) United States Patent
Henriquez

(10) Patent No.: US 8,276,332 B2
(45) Date of Patent: Oct. 2, 2012

(54) PREFABRICATED INSULATION WALL PANELS FOR CONSTRUCTION OF CONCRETE WALLS

(76) Inventor: Jose L. Henriquez, Miami, FL (US)

( * ) Notice: Subject to any disclaimer, the term of this patent is extended or adjusted under 35 U.S.C. 154(b) by 315 days.

(21) Appl. No.: 12/542,150

(22) Filed: Aug. 17, 2009

(65) Prior Publication Data

US 2010/0058686 A1 Mar. 11, 2010

Related U.S. Application Data

(63) Continuation-in-part of application No. 29/310,736, filed on Sep. 8, 2008, now Pat. No. Des. 598,576, and a continuation-in-part of application No. 29/310,739, filed on Sep. 8, 2008, now Pat. No. Des. 605,311.

(51) Int. Cl.
*E04C 2/52* (2006.01)

(52) U.S. Cl. ..... 52/220.2; 52/506.05

(58) Field of Classification Search ..... 52/220.2, 52/407.1, 506.05, 236.3, 794.1, 795.1
See application file for complete search history.

(56) References Cited

U.S. PATENT DOCUMENTS

| | | | | |
|---|---|---|---|---|
| 5,033,248 | A * | 7/1991 | Phillips | 52/742.14 |
| 5,758,463 | A * | 6/1998 | Mancini, Jr. | 52/309.12 |
| 5,787,665 | A * | 8/1998 | Carlin et al. | 52/309.4 |
| 5,842,276 | A * | 12/1998 | Asher et al. | 29/897.32 |
| 7,530,203 | B1 * | 5/2009 | Hare et al. | 52/251 |
| 2010/0058700 | A1 * | 3/2010 | LeBlang | 52/506.05 |

* cited by examiner

*Primary Examiner* — Jeanette E Chapman
*Assistant Examiner* — Daniel Kenny
(74) *Attorney, Agent, or Firm* — CUSPA Technology Law Associates; Yi Li

(57) ABSTRACT

Prefabricated insulation wall panels for construction of a concrete wall include two elongated studs, each having a planar web section and inner and outer flanges, and one or two insulation boards vertically disposed between the two studs. The web section includes multiple through-holes spaced apart in the body portion of the stud, disposed off center in a transverse direction and closer to the inner flange than to the outer flange. The insulation board is thinner than the width of the wed section. The inner surface of the insulation board is disposed against the inner flanges of the studs, with two side edges of the insulation board covering the through-holes on the web section of each stud, thus establishing a distance between the outer surface of the insulation board and the outer flanges of the studs through the body portion of the studs.

25 Claims, 18 Drawing Sheets

300

PREFABRICATED INSULATION WALL PANELS FOR CONSTRUCTION OF CONCRETE WALLS

CROSS REFERENCE TO RELATED APPLICATION

This application is a continuation-in-part of patent application Ser. No. 29/310,736, filed Sep. 8, 2008, now U.S. Pat. No. D598,576, and a continuation-in-part of patent application Ser. No. 29/310,739, filed Sep. 8, 2008, now U.S. Pat. No. D605,311. The parent applications are hereby incorporated by reference in their entirety.

FIELD OF THE INVENTION

The present invention relates to prefabricated insulation wall panels and method of use for construction of concrete walls.

BACKGROUND OF THE INVENTION

It is known that various types of prefabricated building panels for the walls of buildings have been developed for the construction industry. Many of these panels incorporate insulation material to provide thermal insulation property. These existing wall panels are used for construction of walls of only one floor level. Therefore, a building is constructed one floor at a time. Currently, no prefabricated multi-floor wall panels are available in construction industry. Moreover, most commonly the prefabricated wall panels are mechanically attached to supporting structures, such as slabs or beams, and the assembled wall panels are not extensively integrated with other exterior wall components.

On the other hand, some prefabricated wall panels provide designated channels or fixtures for placement of utilities such as conduits, pipes for electric wires and cables within the wall structure. However, these designated fixtures or channels are fixed, which lack of freedom and flexibility in adapting to often changing construction needs.

Furthermore, in the conventional construction process when the wall framing is complete, intermediate supports such as wood or metal strips are attached to the inside of the wall framing first, then the interior finish such as drywall panels are attached to the strips. These are time and labor consuming processes.

Therefore, there is a strong need for improved prefabricated insulation wall panels for construction industry, which can be effectively and extensively integrated with concrete layer of the wall structure to achieve an enhanced structural strength. Furthermore, there is a strong need for two-floor-level wall panels that enable construction of walls for two or more floors at the same time. Moreover, it is desirable to have prefabricated insulation wall panels that provide considerable flexibility in placing utilities within a wall system.

SUMMARY OF THE INVENTION

In one aspect, the present invention is directed to a prefabricated insulation wall panel for construction of a concrete wall. In one embodiment, a prefabricated insulation wall panel for one floor level comprises a first and a second elongated studs aligned in parallel and facing each other; each of the elongated studs comprising a planar web section and an inner flange and an outer flange integrally extending from the web section, and each of the elongated studs having a foot portion, a body portion and a top portion; the planar web section having multiple through-holes spaced apart in the body portion of the stud, the multiple through-holes being disposed off center in a transverse direction of the web section and closer to the inner flange than to the outer flange; and an insulation board having inner and outer surfaces, top and bottom surfaces and two planar side edges and having a thickness less than a width of the web section of the stud; the insulation board being disposed between the first and second elongated studs at the body portions thereof, having each of the side edges of the insulation board against an internal surface of the web section of the studs and covering the multiple through-holes, and having the inner surface of the insulation board against the inner flanges of the studs, thereby establishing a distance between the outer surface of the insulation board and the outer flange of each of the studs through the body portion of each of the studs. The prefabricated insulation wall panel further includes fastening means fastening the insulation board and the elongated studs together. Each stud further includes a top notch in the top portion recessed from the inner flange. The top portions of the two studs of the wall panel may have a same or different length. Similarly, the foot portions of the studs of the wall panel may have a same or different length.

In a further embodiment, a prefabricated two-floor-level insulation wall panel comprises a first and a second elongated studs aligned in parallel and facing each other; each of the elongated studs comprising a planar web section, and an inner flange and an outer flange integrally extending from the web section, and each of the elongated studs having a foot portion, an lower body portion, an upper body portion, a mid-portion between the upper body and lower body portions and a top portion; the planar web section having multiple through-holes spaced apart in the upper and lower body portions of the stud, the multiple through-holes being disposed off center in a transverse direction of the web section and closer to the inner flange than to the outer flange; and a first and a second insulation boards, each thereof having inner and outer surfaces, top and bottom surfaces and two planar side edges and having a thickness less than a width of the web section of the stud; the first insulation board and the second insulation board disposed between the first and second elongated studs at the upper body and lower body portions of the studs, respectively, having each of the side edges of the insulation boards against an internal surface of the web section of the studs and covering the multiple through-holes, and having the inner surface of each of the insulation boards against the inner flanges of the studs, thereby establishing a distance between the outer surface of each of the insulation boards and the outer flange of each of the studs through the upper and lower body portions of the studs. Each stud further includes a top notch in the top portion recessed from the inner flange, and a middle notch recessed from the inner flange in the mid-portion of the stud. The top portions of the two studs of the wall panel may have a same or different length. Similarly, the foot portions of the studs of the wall panel may have a same or different length.

In a further aspect, the present invention is directed to a wall assembly. In one embodiment, the wall assembly comprises a plurality of one-floor-level wall panels described above, wherein the plurality of prefabricated insulation wall panels are aligned one next to another, having the inner surface of the insulation board facing an interior of a building structure and having the web sections of the elongated studs against each other, such that the multiple through-holes on the web section of each of the elongated studs among the plurality of wall panels are in alignment. The wall assembly further comprises a header beam disposed in a top notch trail formed by aligned top notches. Moreover, the insulated wall assembly further comprises a concrete layer having an integral internal portion thereof penetrated into and filled a space between the outer surface of the insulation board and the outer flanges of the studs of each of the wall panels and a continuous external portion throughout the assembly.

In a further embodiment, the present invention provides a two-floor-level wall assembly, which comprises a plurality of two-floor-level wall panels described above, wherein the plurality of prefabricated insulation wall panels being aligned one next to another, having the inner surface of the insulation board facing an interior of a building structure and having the web sections of the elongated studs against each other, such that the multiple through-holes on the web section of each of the elongated studs among the plurality of wall panels are in alignment. The wall assembly further comprises a first header beam disposed in a top notch trail formed by aligned top notches and a second header beam disposed in a middle notch trail formed by aligned middle notches through the assembly.

In another aspect, the present invention provides the method of constructing concrete walls using the prefabricated wall panels described above.

The advantages of the present invention will become apparent from the following description taken in conjunction with the accompanying drawings showing exemplary embodiments of the invention.

BRIEF DESCRIPTION OF THE DRAWINGS

It is noted that in the drawings like numerals refer to like components.

DETAILED DESCRIPTION OF THE INVENTION

Figure 1:
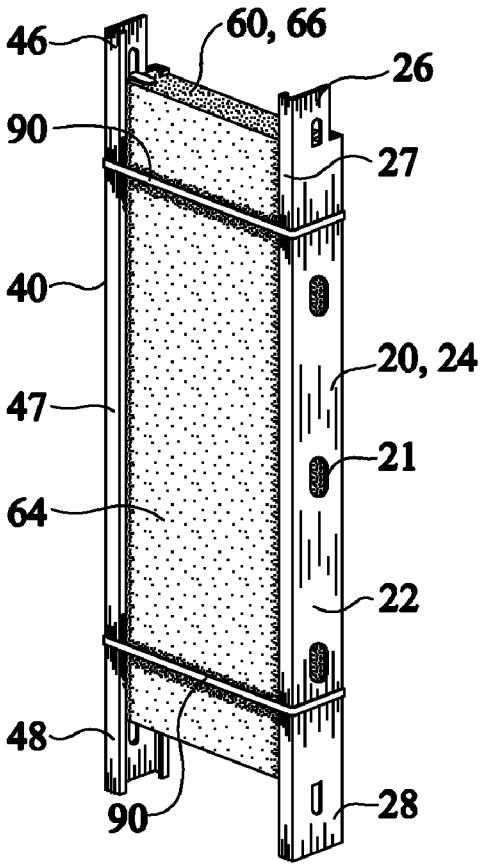
FIG. 1 is a front perspective view of an insulated wall panel in one embodiment of the present invention, adapted for construction of a concrete wall of one floor level, showing the outer side of the wall panel.
Figure 2:
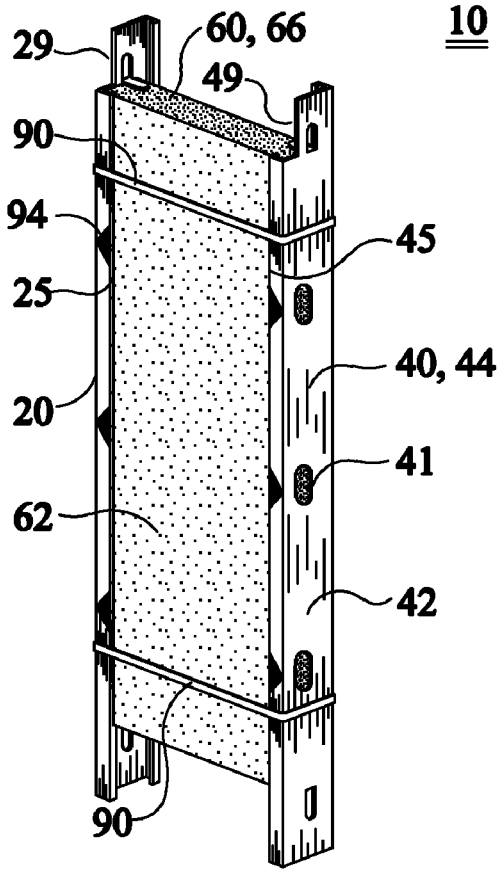
FIG. 2 is a rear perspective view of the insulated wall panel shown in FIG. 1, showing the inner side of the wall panel.

In one aspect, the present invention provides prefabricated insulation wall panels for construction of a concrete wall.

FIGS. 1-9 show a prefabricated insulation wall panel 10 in one embodiment of the present invention, which is suitable for construction of concrete walls for one floor level. The prefabricated insulation wall panel 10 comprises two elongated studs 20 and 40, an insulation board 60 and fastening means 90.

As shown in FIGS. 1-5, the first elongated stud 20 includes a planar central web section 22 and two flange members 25 and 27 integrally extending from the web section 22. Because of the orientation of wall panel 10 when it is assembled in a building structure, flange member 25 is herein referred to as an inner flange and flange member 27 is herein referred to as an outer flange, respectively. Similarly, the second elongated stud 40 includes a planar central web section 42 and an inner flange 45 and outer flange 47 integrally extending from the web section 42. Elongated studs 20 and 40 have top portions 26, 46 having a flat upper end, foot portions 28, 48 having a flat lower end, and body portions 24, 44, respectively. It is noted that in the drawings, the front view corresponds to the outer side of wall panel 10, and the rear view corresponds to the inner side of the wall panel.

In the embodiment shown, each of elongated studs 20 and 40 has a top notch 29, 49, recessed from the side of inner flange 25, 45. The top notches 29 and 49 have a L-shaped cross-section, which can be formed by cutting out the inner flange and partially into the web section. Typically, the top notch has a height from about 3.625 inches to about 12 inches and a depth from about 1.625 inches to about 2.5 inches. In construction, the top notches are used to receive and support a header beam for supporting roof structures, as further described hereinafter. In an alternative embodiment, the top portion of the stud does not include a notch, instead, a separate bracket can be secured on to the inner flange. In this embodiment, the header beam is disposed within and supported by the bracket.

Figure 3:
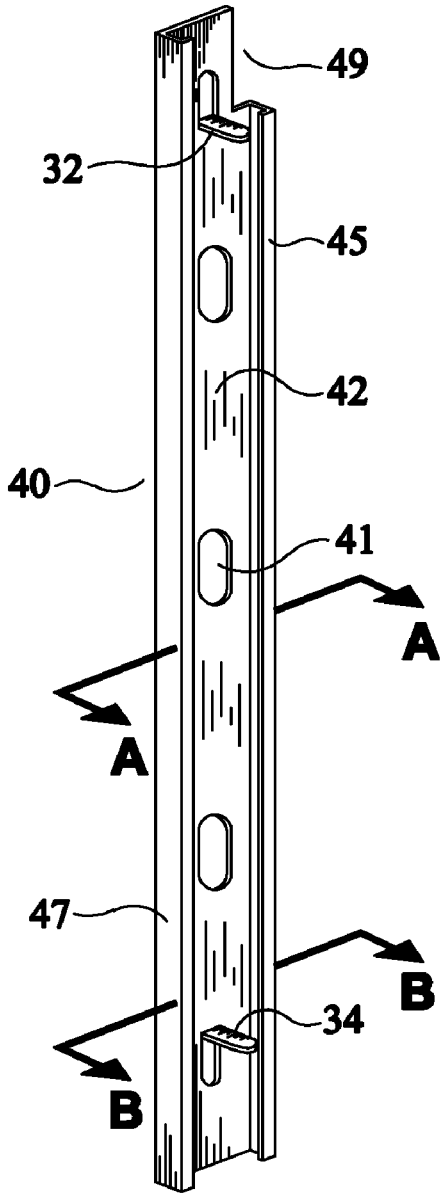
FIG. 3 is a perspective view of one stud of the insulated wall panel shown in FIG. 1.

As shown in FIGS. 1-2 and 6-7, in each elongated stud the planar web section 22, 42 includes multiple through-holes 21, 41 spaced apart in the body portion 24, 44 of the stud. The multiple through-holes within each stud are spaced apart with a predetermined distance D1 along the longitudinal axis 3 of the panel. Since these multiple through-holes are used for placing utilities such as electrical wires, cables and plumbing pipes for the buildings, as further described hereinafter, typically they are spaced apart in an increment of 8 inches, or 16 inches. However, distance D1 between two adjacent through-holes in the longitudinal direction can be different, so long as a pair of through-holes between the first and the second studs 20 and 40 are aligned horizontally, namely along lateral axis 7 of the wall panel (see FIG. 8). The through-holes can have various shapes, such as circular, elliptical, square, rectangular, and triangle. Preferably, the through-holes have smoothed corners as shown in FIG. 3, to avoid uneven force distribution at the sharp corners. For placing utilities, the through-holes typically have a width from about 1.25 to about 4.25 inches, and a height from about 1.25 to about 6 inches.

Figure 6:
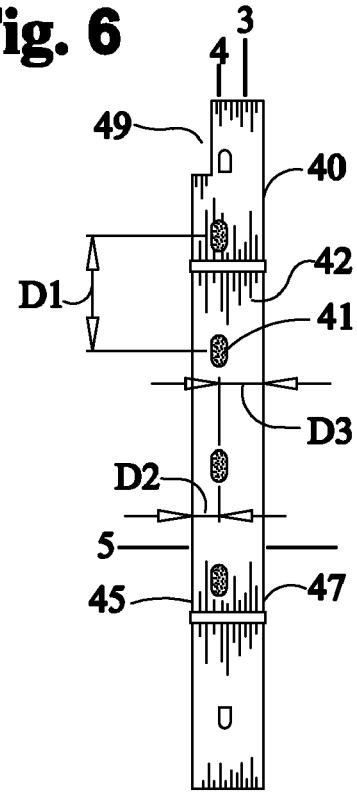
FIG. 6 is a left side elevational view of the insulated wall panel shown in FIG. 1.
Figure 7:
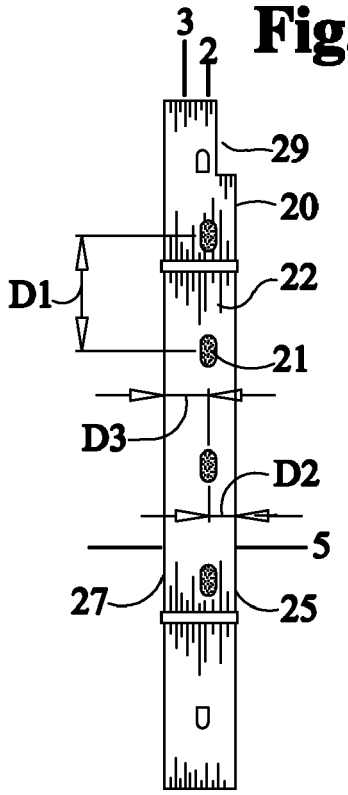
FIG. 7 is a right elevational view of the insulated wall panel shown in FIG. 1.
Figure 8:
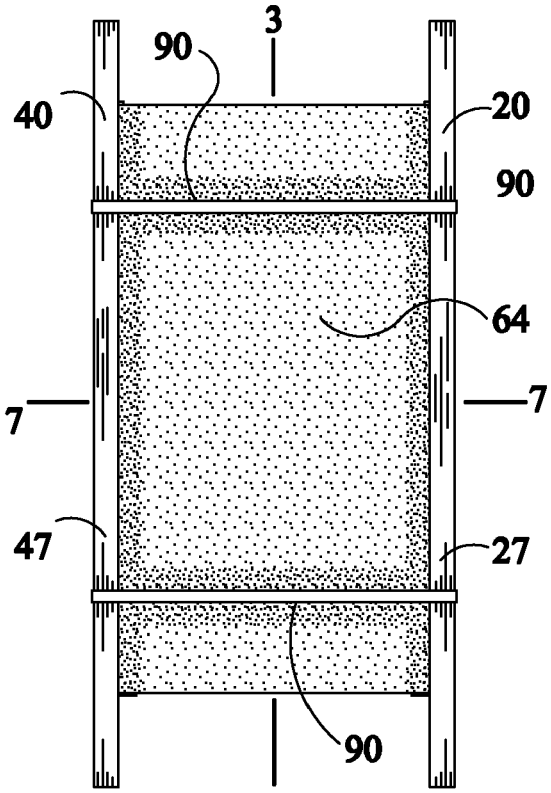
FIG. 8 is a front elevational view of the insulated wall panel shown in FIG. 1.

As best shown in FIGS. 6 and 7, in the first stud 20 multiple through-holes 21 are disposed off center in the transverse direction (the direction of transverse axis 5) of web section 22 and are closer to inner flange 25 than to outer flange 27. Similarly, in the second stud 40 multiple through-holes 41 are disposed off center in the transverse direction of web section 42 and are closer to inner flange 45 than to outer flange 47. In the embodiment shown, multiple through-holes 21 and 41 are aligned along centerlines 2 and 4 of the through-holes, respectively. The centerlines 2 and 4 are in parallel with the longitudinal axis 3 of the wall panel, which is also the longitudinal axis of the studs, and have a transverse distance D2 to the inner flange 25 and 45 shorter than a corresponding distance D3 to the outer flange 27 and 47. D2 and D3 of the first stud 20 are the same as D2 and D3 of the second stud 40, respectively. As such, each pair of through-holes between the two studs is also aligned in the transverse direction of the wall panel, namely the direction of transverse axis 5. It should be understood, however, that the multiple through-holes within one stud can also be not aligned along a centerline, so long as the pair of through-holes between the two studs have the same distances D2 and D3.

Figure 9:
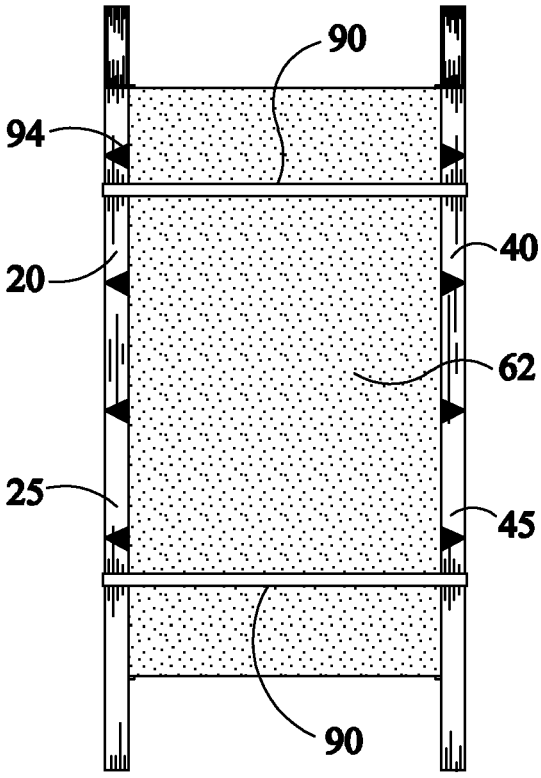
FIG. 9 is a rear elevational view of the insulated wall panel shown in FIG. 1.
Figure 10:
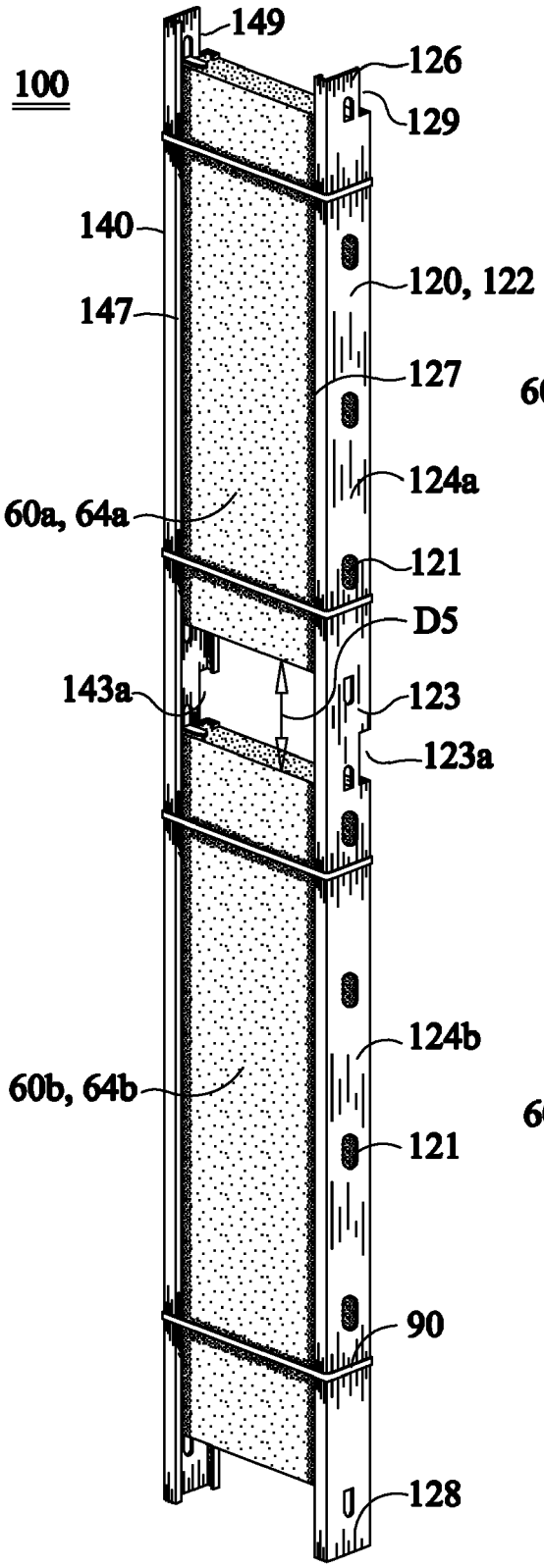
FIG. 10 is a front perspective view of an insulated wall panel for construction of a concrete wall of two floor levels in another embodiment of the present invention, showing the outer side of the wall panel.
Figure 11:
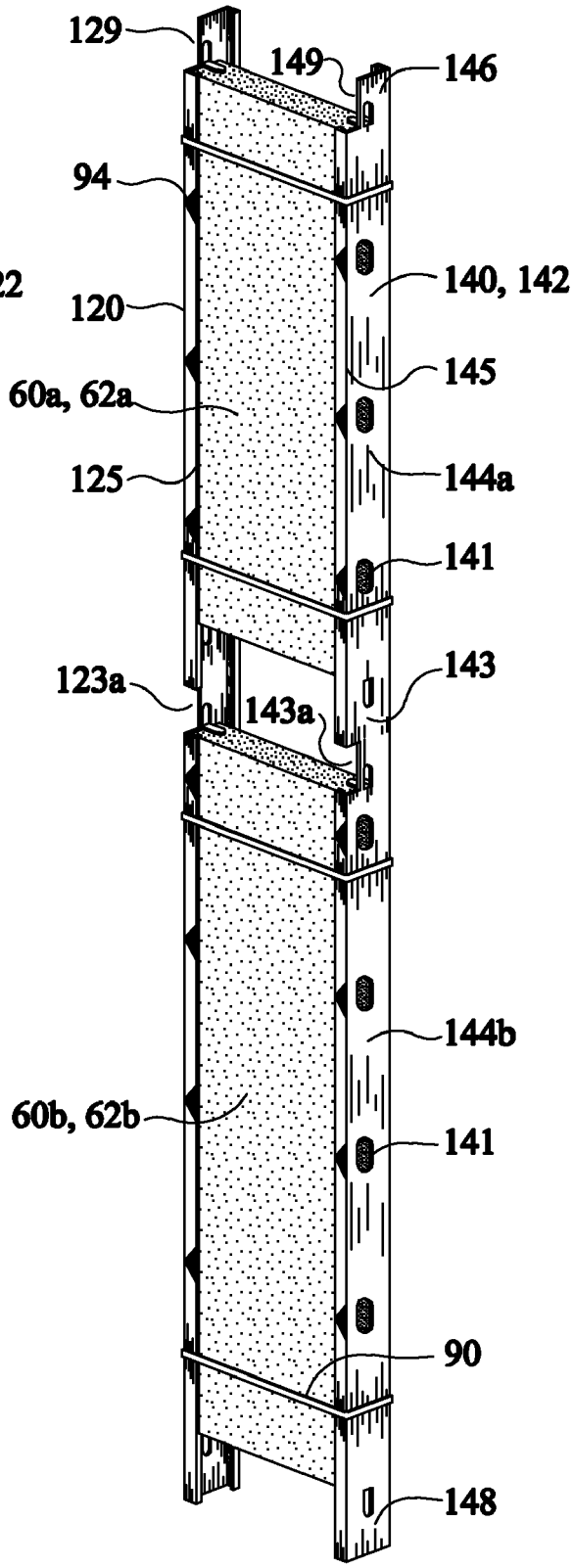
FIG. 11 is a rear perspective view of the insulated wall panel shown in FIG. 10, showing the inner side of the wall panel.

As further shown in FIG. 9, optionally each of the studs 20 and 40 further includes alignment markings 94 on the external surface of inner flange 25, 45. The alignment markings 94 are provided at the same position of the through-holes in the longitudinal direction. As such, when multiple wall panels are assembled in construction as further described hereinafter, the through-holes on the web section between the adjacent wall panels can be aligned conveniently and accurately with the assistance of the alignment markings. The alignment markings can be provided by printing, painting, stamping, embossing, or other suitable methods. In the embodiment shown in FIG. 9, the alignment markings 94 have a triangle shape, however, any other suitable shapes, such as arrow, line, and diamond can also be used.

As shown in FIGS. 1-2 and 4-5, the first and second elongated studs 20 and 40 are aligned in parallel and face each other. Preferably, web sections 22, 42 of the two studs have the same width (measured in the direction of transverse axis 5), and as shown, the top notches 29 and 49 are aligned with each other. Wall panel 10 typically has a width in the lateral direction from about 0.5 to about 4 feet, the top portions of the studs may have a height or length from about 3.5 to about 16 inches, and the foot portions of the studs may have a length from about 6 to about 72 inches.

In the exemplary embodiment shown in FIGS. 1-9, first and second elongated studs 20 and 40 have a structure as a mirror image of each other. However, as further discussed hereinafter, the top portions and foot portions of the two studs within one wall panel can also be different.

Figure 4:
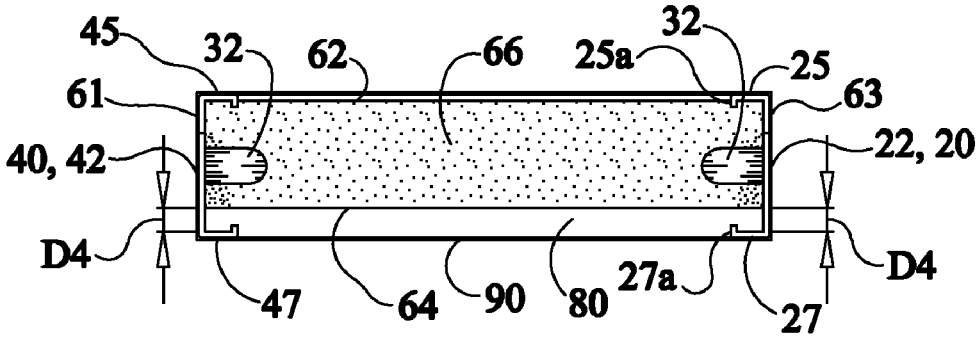
FIG. 4 is a top plan view of the insulated wall panel shown in FIG. 1.
Figure 3A:
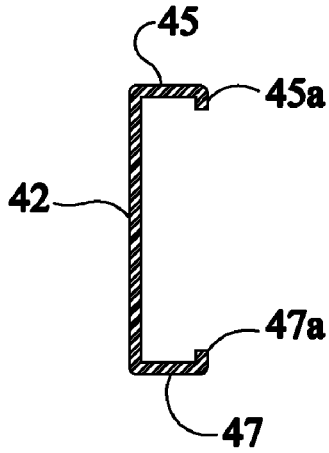
FIGS. 3*a* and 3*b* are cross sectional views of the stud along line A-A and line B-B in FIG. 3, respectively.
Figure 3B:
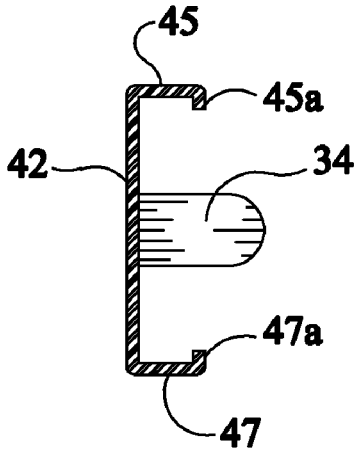
Figure 5:
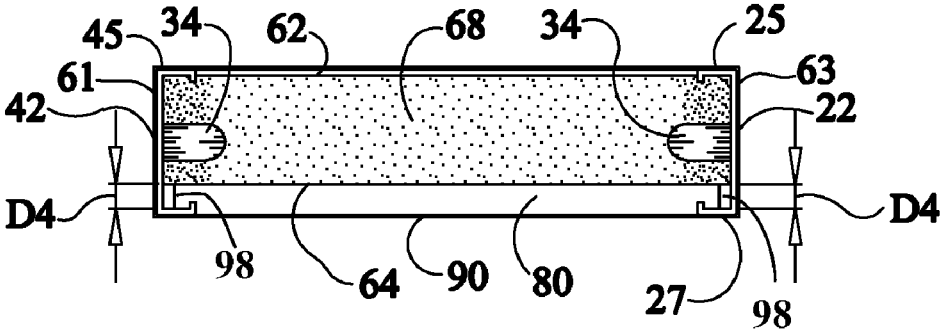
FIG. 5 is a bottom plan view of the insulated wall panel shown in FIG. 1.

For the purpose of the present invention, the elongated studs can have a U-shaped or a C-shaped cross section. Preferably, studs having a C-shaped cross section, as shown in FIGS. 3-5, are used because of their structural strength, and these are also referred to as C-stud. As shown in FIG. 3*a*, with a C-stud 40 each flange member 45 or 47 further includes an edge flange 45*a* or 47*a*. The edge flanges 45*a* and 47*a* are substantially perpendicular to the corresponding flange members 45 and 47, respectively. The same applies to flange members 25 and 27 of stud 20.

The insulation board 60 has an inner surface 62, an outer surface 64, a top surface 66, a bottom surface 68, and two planar side edges 61 and 63. As shown in FIGS. 1-2, 4-5 and 8-9, insulation board 60 is disposed between first and second elongated studs 20 and 40 at their body portions 24, 44, with side edges 61 and 63 against the internal surface of web sections 22 and 42 of the studs, which leaves the top portions and foot portions of the studs unobstructed.

Insulation board 60 has a thickness (in the direction of transverse axis 5) less than the width of web section 22, 42 of the studs. Inner surface 62 of insulation board 60 is disposed against inner flanges 25 and 45 of studs 20 and 40, thereby establishing a distance D4 between outer surface 64 of insulation board 60 and outer flanges 27 and 47 of studs 20 and 40 through the body portions of the studs (see FIGS. 4 and 5). Preferably, the thickness of insulation board 60 is from about ½ to about ⅘, preferably from about ⅔ to about ¾, of the width of web section of the studs, such that distance D4 is from about ⅕ to about ½, preferably from about ¼ to about ⅓, of the width of web section of the studs.

As shown in the top and bottom views of wall panel 10 as illustrated in FIGS. 4 and 5, in the presence of distance D4 on both sides of wall panel 10, the wall panel has a hollow space 80 across outer surface 64 of insulation board 60 in both longitudinal and lateral directions. In the formed wall panel 10, the side of the panel having space 80 is referred to as the outer side and the opposing side is referred to as the inner side. Space 80 will be filled with concrete during construction to form an insulated wall system, as described in details hereinafter. Preferably, insulation board 60 is planar with the inner and outer surfaces in parallel. In such a configuration, distance D4 is substantially uniform throughout the body portion of each of the studs, and space 80 has the same depth (from the outer flanges to outer surface 64 of insulation board 60) throughout the outer surface of the insulation board.

The thickness of insulation board 60, as well as distance D4, can be determined based on the size of the studs, strength requirements of a wall system, the amount of insulation capacity desired, and other structural considerations. However, the thickness of insulation board 60 is sufficient to enable side edges 61 and 63 covering all through-holes 21 and 41 on the web sections of both studs, as shown in FIGS. 6 and 7. Preferably, a center in the thickness of insulation board 60 is substantially in alignment with the centerline of the through-holes on the wed section of each of the studs.

Insulation board 60 may be constructed of any material which provides thermal and/or acoustical insulation including, for example, polymeric materials, such as polystyrene, polyurethane, and composites. Moreover, the material can be cut by knife, or heat deformable, or both. The heat deformable material does not produce smoke or toxic gas. Preferably, rigid polymeric foams, such as expanded polystyrene foam (EPS) or polyurethane foams, are used.

The first and second elongated studs 20 and 40 and insulation board 60 are fastened together by a fastening means. In the embodiment shown, the fastening means includes two strapping bands 90 that strap around elongated studs 20 and 40 in the body portion to tightly hold insulation board 60 and the studs together. The strapping band can be made of any suitable materials, such as sheet metal, plastics such as nylon, vinyl, and fiberglass. In one exemplary embodiment, a vinyl strap having a width from about ½ to 1 inch is used. Various other fastening means can also be used, including but not limited to, adhesives, screws and pins. These fastening means can be provided at the interfaces between the insulation board and the elongated studs to hold the insulation board and the studs together.

As shown in FIGS. 3, 3*b*, 4 and 5, preferably each of elongated studs 20 and 40 further includes a pair of anchoring members 32 and 34, which protrude from the internal surface of web section 22, 42. Insulation board 60 is disposed between the two pairs of anchoring members 32 and 34 in the longitudinal direction. These anchoring members prevent insulation board 60 from moving in the longitudinal direction during transportation and construction of the walls. Because of friction, the anchoring members also inhibit movement of the insulation board in transverse direction. In the embodiment shown, the anchoring member is a tab, formed by partial stamping on the web section 24, 44, and inwardly bending the tab, preferably perpendicular to the web section. Alternatively, the anchoring member can also be a separate component fastened to the internal surface of the web section, such as metal plates, pins, and brackets. Preferably, the surface of an anchoring member in contact with the insulation board is planar.

Optionally, wall panel 10 can further include one or more spacers at 98 disposed on each side of the wall panel between outer surface 64 of insulation board 60 and outer flanges 27 and 47 of studs 20 and 40. The spacers assist in maintaining distance D4 during transportation and construction. The spacers can have any suitable structure and shape, such as block, wedge and bracket. Preferably, the surface of the spacer in contact with the insulation board is planar. The spacers can be made of any suitable materials, including but not limited to, metal, plastics, and wood. The spacers can also be tabs formed by stamping or punching the stud.

In a further embodiment, the present invention provides a prefabricated two-floor-level wall panel 100, which is suitable for construction of concrete walls for two floor levels. Referring now to FIGS. 10-18, as shown the first elongated stud 120 includes a planar central web section 122 and inner flange 125 and outer flange 127 integrally extending from web section 122. Similarly, the second elongated stud 140 includes a planar central web section 142 and an inner flange 145 and outer flange 147 integrally extending from the web section 142. Each of elongated studs 120 and 140 has a top portion 126, 146, a foot portion 128, 148, a middle portion 123, 143, and an upper body portion 124*a*, 144*a* and a lower body portion 124*b* and 144*b*, above and below the middle portion 123, 143, respectively. Each of elongated studs 120 and 140 has a top notch 129, 149, and a middle notch 123*a*, 143*a*, all recessed from the side of inner flange 125, 145. The structure of top notches 129 and 149 are the same as that described in wall panel 10. The middle notches 123*a* and 143*a* have a U-shaped cross section, formed by cutting through inner flanges 125 and 145, respectively, and partially into the respective web section. The height and the depth of the middle notch can vary depending on the size of the stud. Typically, the middle notch has a height from about 3.625 to about 16 inches, and a depth from about 1.625 to about 3 inches.

As shown in FIGS. 10-11 and 15-16, in each elongated stud 120, 140 the planar web section 122, 142 includes multiple through-holes 121, 141 spaced apart within the upper and lower body portions 124*a* and 124*b*, 144*a* and 144*b* of the studs, respectively. Similarly to the through-holes in wall panel 10 described above, multiple through-holes 121, 141 are spaced apart with a predetermined distance D1 along the longitudinal axis 3 of the panel within the upper and lower body portions 124*a* and 124*b*. The shape and size of the through-holes 121, 141 are same as those of through-holes 21 and 41 described above.

Moreover, same as those described above in wall panel 10, as shown in FIGS. 15-16 in wall panel 100 through-holes 121 are disposed off center in the transverse direction (the direction of transverse axis 5') of web section 122 of the first stud 120, and through-holes 141 are disposed off center in the transverse direction of web section 142 of the second stud 140. In each stud, the through-holes are closer to inner flange 125, 145 than to outer flange 127, 147. The alignment of through-holes 121, 141 and the distances D2 and D3 are the same those described above in wall panel 10.

As shown in FIGS. 10-11 and 17-18, the first and second elongated studs 120 and 140 are aligned in parallel and face each other. Preferably, web sections 122, 142 of the two studs have the same width. Wall panel 100 typically has a width in the lateral direction from about 1 to about 4 feet, the top portions of the studs may have a height or length from about 3.5 to about 16 inches, and the foot portions of the studs may have a length from about 6 to about 72 inches. As shown, the top notches 129 and 149 are aligned with each other, and the middle notches 123*a* and 143*a* are aligned with each other. In the exemplary embodiment shown in FIGS. 10-18, first and second elongated studs 120 and 140 have a structure as a mirror image of each other. However, as further discussed hereinafter, the top portions and foot portions of the two studs within one wall panel can also be different. The cross sectional structure of the studs is the same as those described above in wall panel 10.

As shown in FIGS. 10-11 and 17-18, wall panel 100 has two insulation boards 60*a* and 60*b* disposed between first and second elongated studs 120 and 140 at their upper body portions 124*a*, 144*a* and lower body portions 124*b*, 144*b*, respectively. In wall panel 100 in addition to the top portions and foot portions of the studs, the middle portions are also unobstructed.

Figure 13:
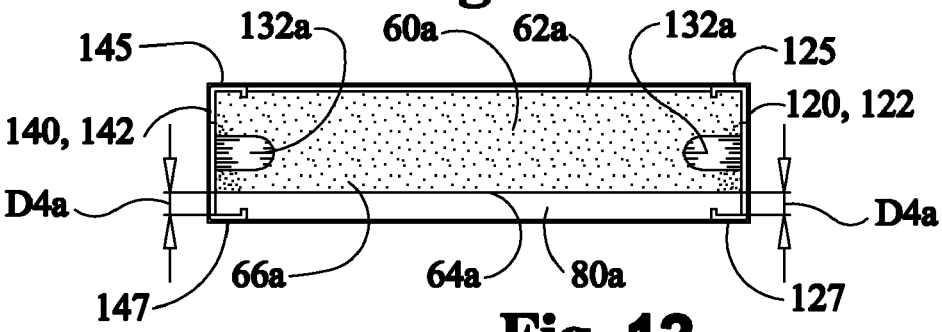
FIG. 13 is a top plan view of the insulated wall panel shown in FIG. 10.
Figure 14:
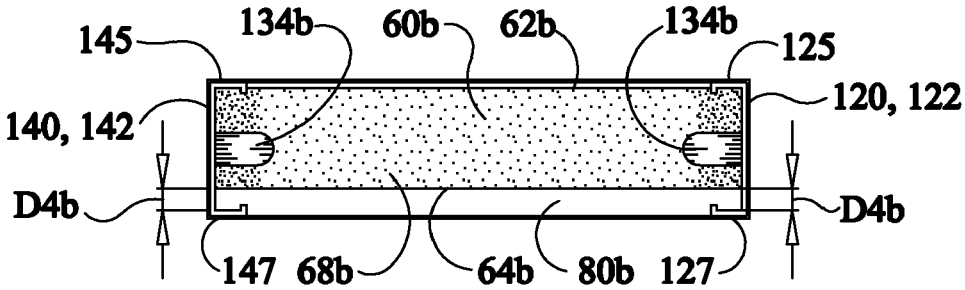
FIG. 14 is a bottom plan view of the insulated wall panel shown in FIG. 10.

The structure and material of insulation boards 60*a* and 60*b* and their placement relative to the first and second studs within wall panel 100 are the same as those described in wall panel 10. Therefore, there is an established distance D4*a* between outer surface 64*a* of insulation board 60*a* and outer flanges 127 and 147 of studs 120 and 140 through the upper body portions of the studs, and wall panel 100 has a hollow space 80*a* across outer surface 64*a* of insulation board 60*a* in both longitudinal and lateral directions (see FIGS. 13 and 17). Similarly, there is an established distance D4*b* between outer surface 64*b* of insulation board 60*b* and outer flanges 127 and 147 of studs 120 and 140 through the lower body portions of the studs, and wall panel 100 has a hollow space 80*b* across outer surface 64*b* of insulation board 60*b* in both longitudinal and lateral directions (see FIGS. 14 and 17). Insulation boards 60*a* and 60*b* can have a same thickness. In such a configuration as shown in FIGS. 13-14, distance D4*a* and distance D4*b* are the same and the depth of the hollow spaces 80*a* and 80*b* in the upper and lower body portions is the same. As such, only one insulation board can be seen in either the top view or the bottom view. However, insulation boards 60*a* and 60*b*may also have a different thickness. With this configuration, since the depth of the hollow spaces 80*a* and 80*b* in the upper and lower body portions is different, the thickness of the concrete layer of a constructed wall between different floor levels is different.

Figure 15:
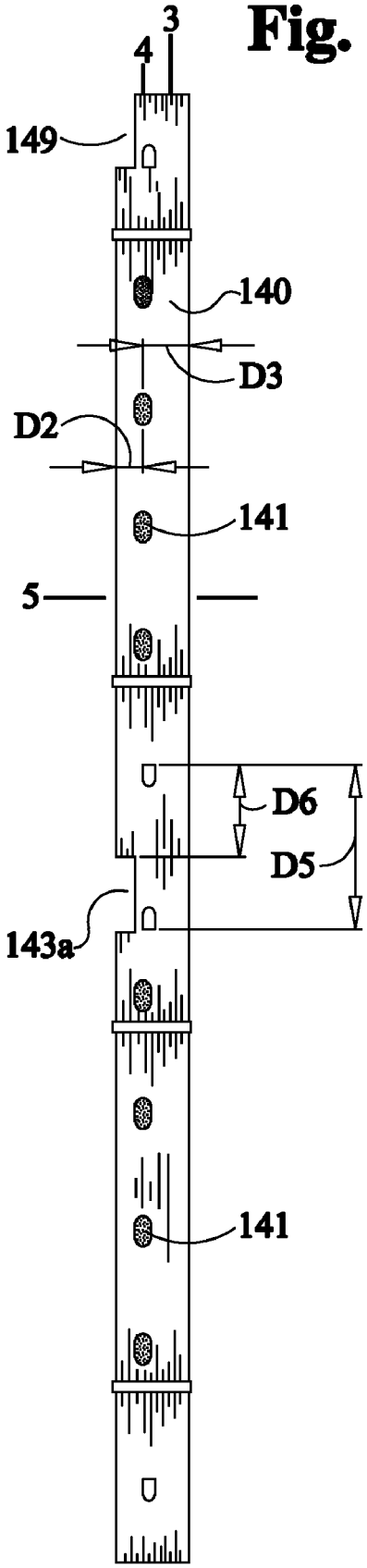
FIG. 15 is a left side elevational view of the insulated wall panel shown in FIG. 10.
Figure 16:
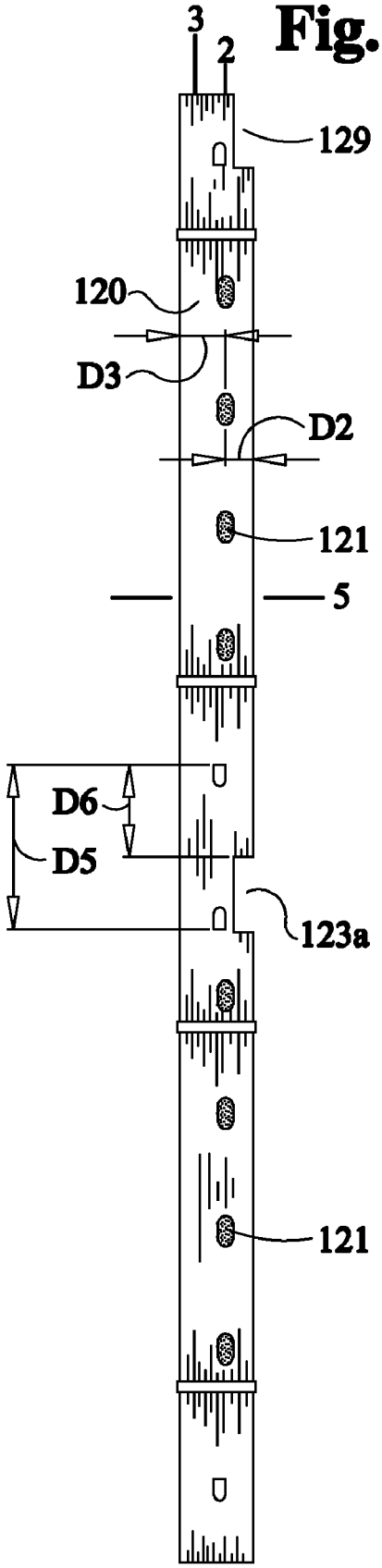
FIG. 16 is a right elevational view of the insulated wall panel shown in FIG. 10.
Figure 17:
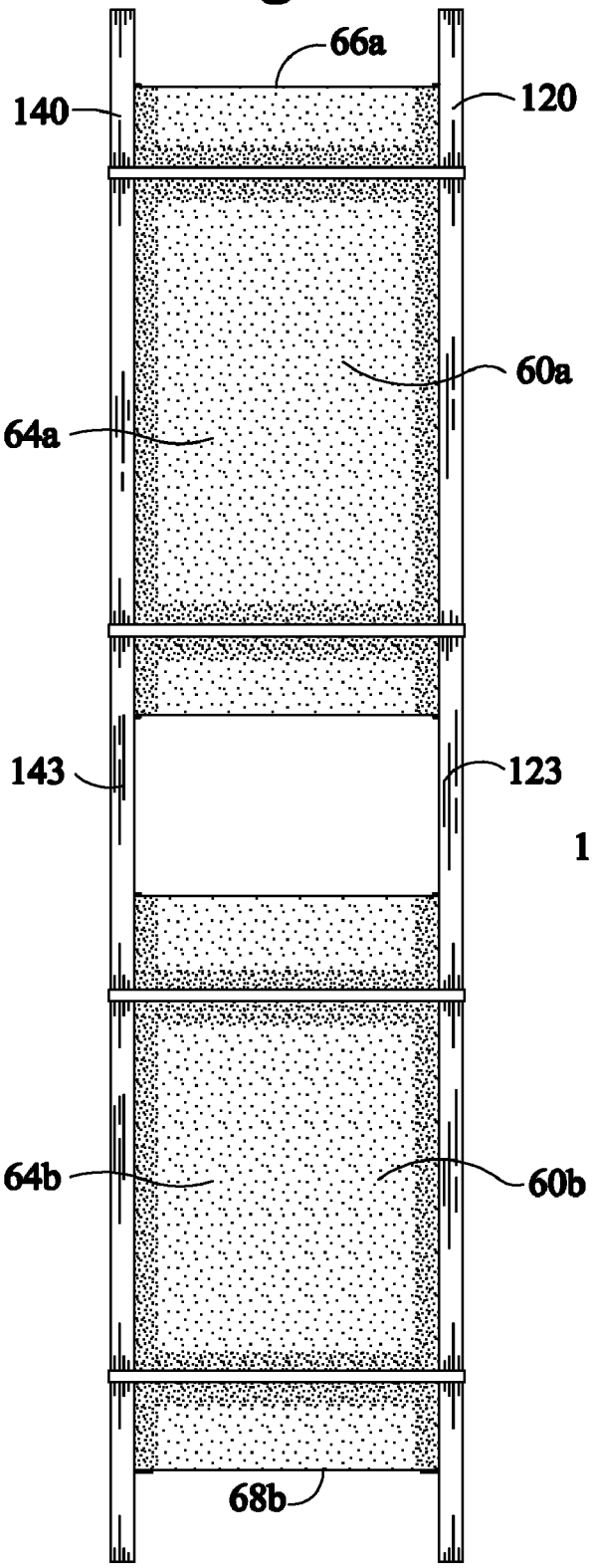
FIG. 17 is a front elevational view of the insulated wall panel shown in FIG. 10.
Figure 18:
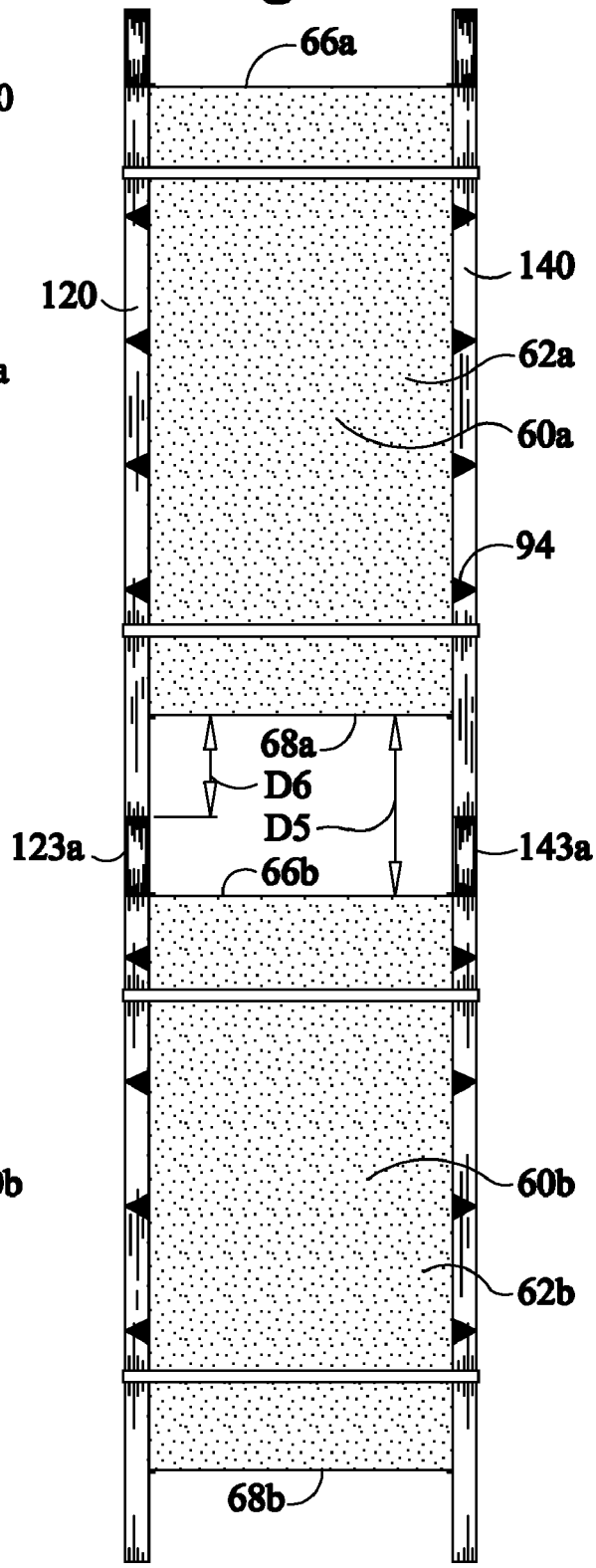
FIG. 18 is a rear elevational view of the insulated wall panel shown in FIG. 10.

In either configuration discussed above, the thickness of insulation boards 60*a* and 60*b* is sufficient to enable the side edges covering through-holes 121 and 141 on the web sections of both studs, as shown in FIGS. 15-16. Preferably, the center in the thickness of insulation board 60*a* and 60*b* is substantially in alignment with the centerline of the through-holes on the wed section of each of the studs.

As shown in FIGS. 10-12 and 18, in the middle section of wall panel 100 there is a distance D5 between the bottom surface 68*a* of insulation board 60*a* and the top surface 66*b* of insulation board 60*b*. Preferably, the top surface 66*b* of insulation board 60*b* is flush with or immediately underneath the bottoms of middle notches 123*a* and 143*a*. There is a predetermined distance D6 between the bottom surface 68*a* of insulation board 60*a* and the upper ends of middle notches 123*a* and 143*a*. During construction of walls of two floor levels, a header beam is placed into the middle notches 123*a* and 143*a* of wall panel 100, and floor panels are placed on top of and supported by the header beam. Preferably, distance D6 is equal to or less than the thickness of the floor panels, depending on the structure of the floor panels to be used. The height of insulation boards 60*a* and 60*b* may be same or different, depending on the height of the walls of the corresponding floor level of a building.

As shown in FIGS. 10-11 and 15-18, the first and second elongated studs 120 and 140 and insulation boards 60*a* and 60*b* are fastened together by four strapping bands 90 that strap around the studs in the upper and lower body portions. As described above, other suitable fastening means can also be used.

Figure 12:
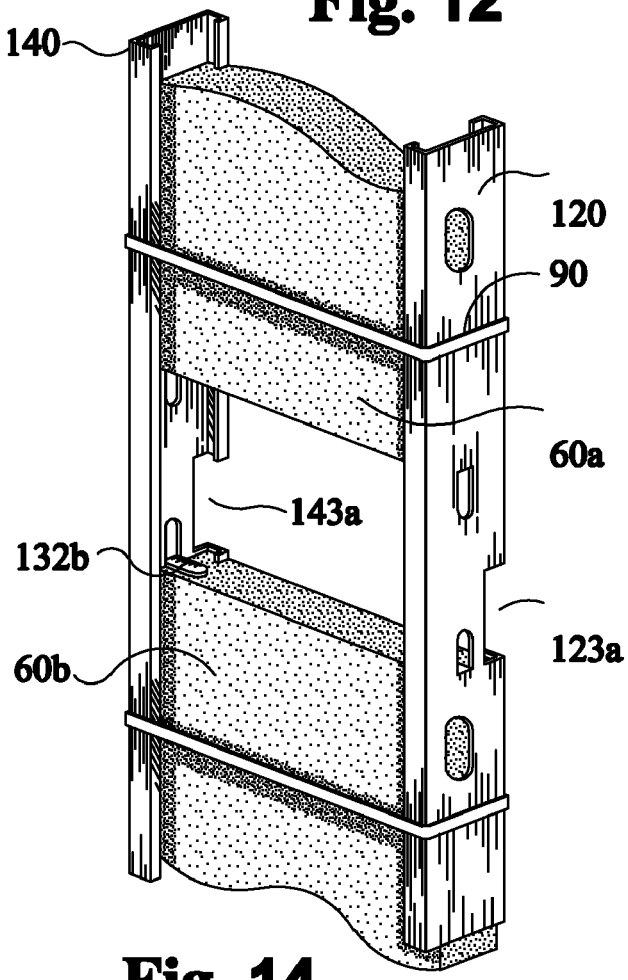
FIG. 12 is an enlarged partial front perspective view of the insulated wall panel shown in FIG. 10, showing the middle section of the wall panel.

As further shown in FIGS. 12-14, preferably each of elongated studs 120 and 140 further includes two pairs of anchoring members (only 132*a*, 132*b* and 134*b* are shown in the drawings), which protrude from the internal surface of web section 122, 142. Each insulation board 60*a* or 60*b* is disposed between two pairs of anchoring members in the longitudinal direction. The structure and function of the anchoring members are the same as those described above in wall panel 10. Moreover, similar to wall panel 10, wall panel 100 can further include one or more spacers disposed on each side of the wall panel between the outer surface of the insulation boards and outer flanges of the studs in the upper and lower body portions.

Figure 19:
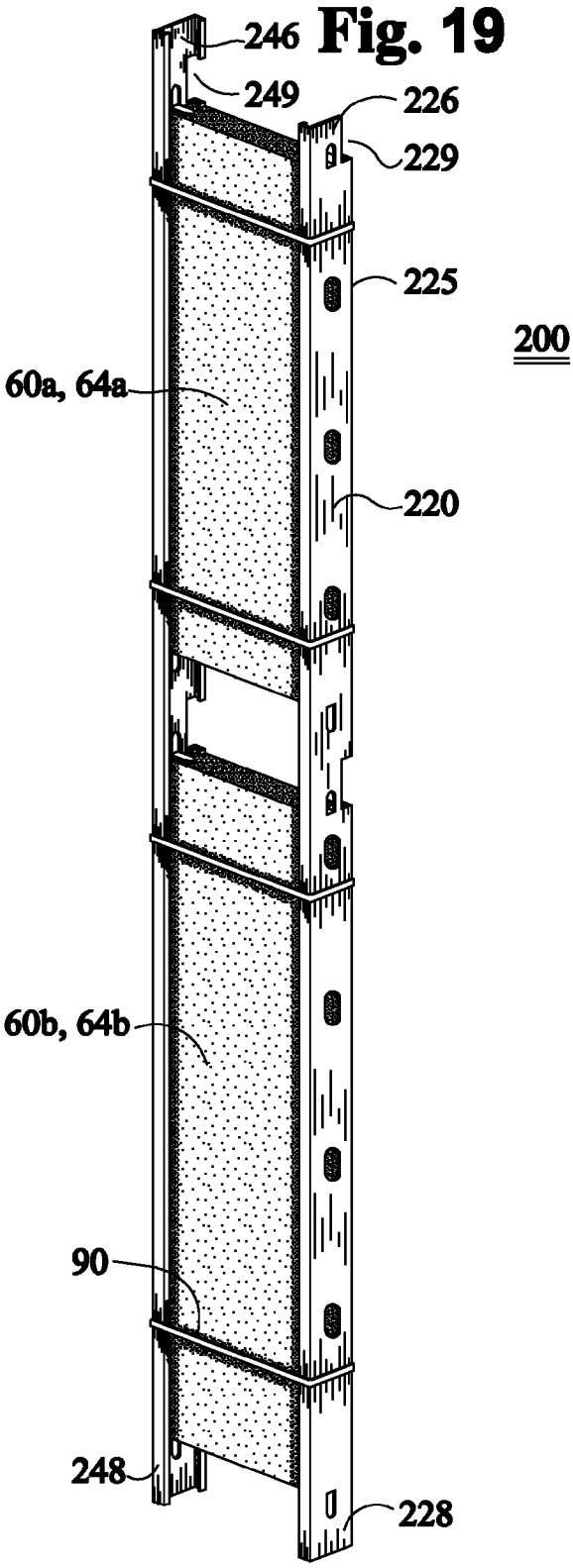
FIG. 19 is a front perspective view of a two-floor-level insulated wall panel in a further embodiment of the present invention, wherein the top portions of the elongated studs have an uneven length and the foot portions of the two elongated studs have an even length.
Figure 20:
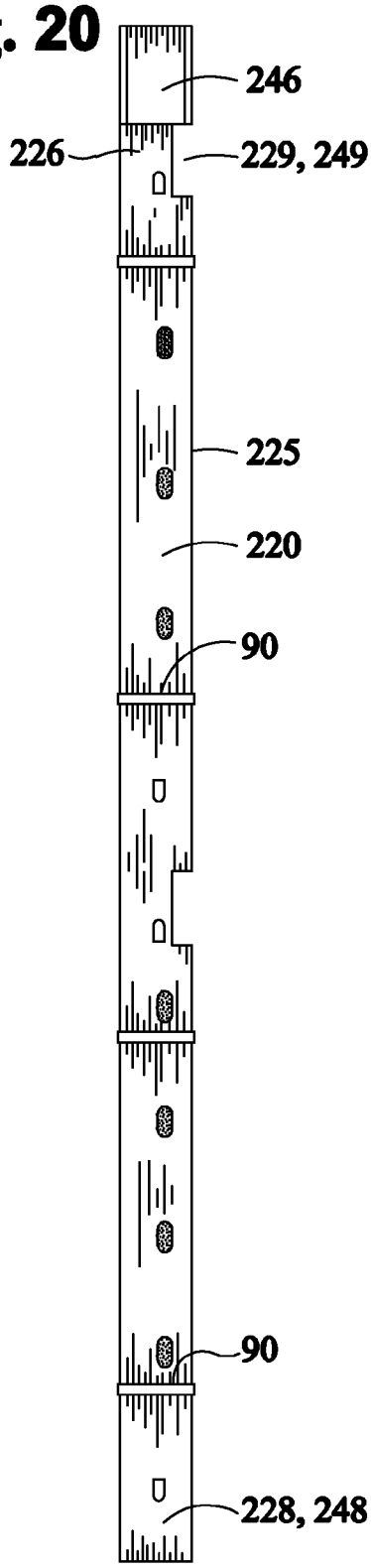
FIG. 20 is a side view of a two-floor-level insulated wall panel shown in FIG. 19.

Referring now to FIGS. 19-27, the present invention further provides two-floor-level wall panels 200, 300, and 400, which are suitable for construction of walls for a building having two or more floor levels. FIGS. 19-20 show a front perspective view and a side view of wall panel 200, respectively. Wall panel 200 has the same structure of the two-floor-level wall panel 100 described above, except that top portions 226 and 246 of the first and second elongated studs 220 and 240 have a different or uneven height. As shown, top portion 226 of the first elongated stud 220 has the same structure as that of the first elongated stud 120 in wall panel 100, which includes a top notch 229 recessed from the side of inner flange 225. The top portion 246 of the second elongated stud 240 is higher than that of the first elongated stud 220, typically from about 3.625 to about 16 inches. Top notch 249 of the second elongated stud 240 has the same height and depth as those of the top notch 229 of the first elongated stud 220, however, it is not positioned at the top end. Top notch 249 of the second elongated stud 240 is so positioned that in wall panel 200 the two top notches are aligned with each other in longitudinal, transverse and lateral directions. In the embodiment shown, top portion 246 is higher than top portion 226, however, the relationship can be reversed, namely top portion 226 can also be higher than top portion 246. It is noted that in wall panel 200, foot portions 228 and 248 of the first and second studs have a same or even length.

In the embodiment shown, top notch 229 has a L-shape and top notch 240 has a U-shape in their cross sections. Alternatively, neither stud has the top notch. Instead, a separate support means, such as bracket or c-channel can be firmly attached to the inner flange of the stud, for receiving and supporting a header beam during construction.

Figure 21:
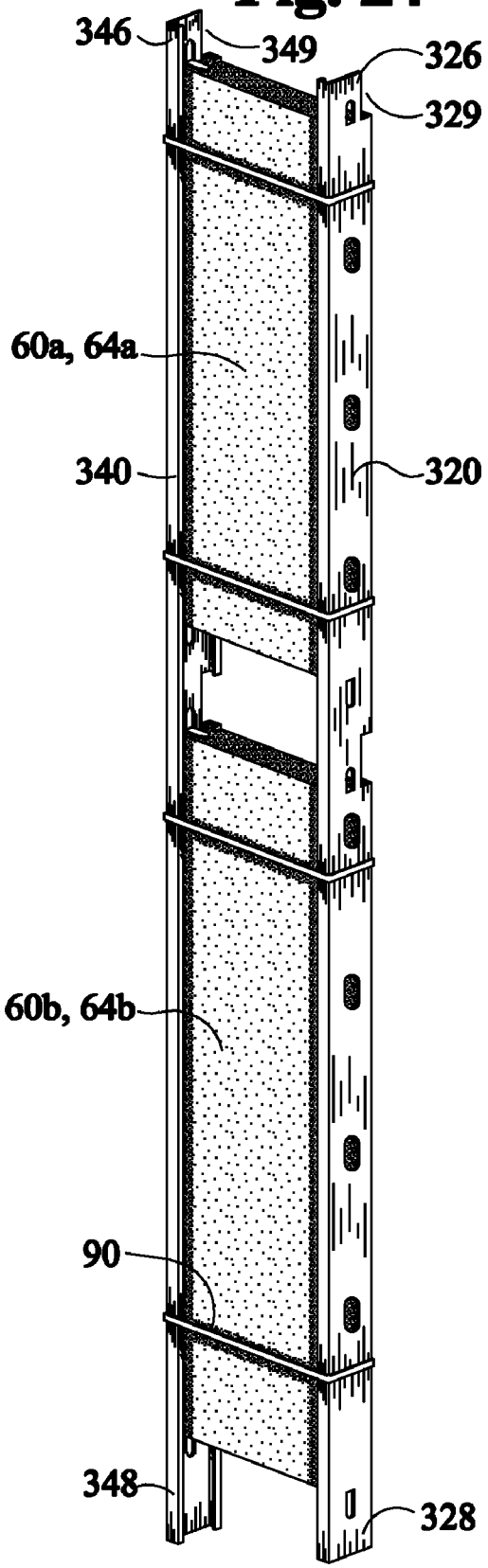
FIG. 21 is a front perspective view of a two-floor-level insulated wall panel in a yet further embodiment of the present invention, wherein the top portions of the elongated studs have an even length and the foot portions of the two elongated studs have an uneven length.
Figure 22:
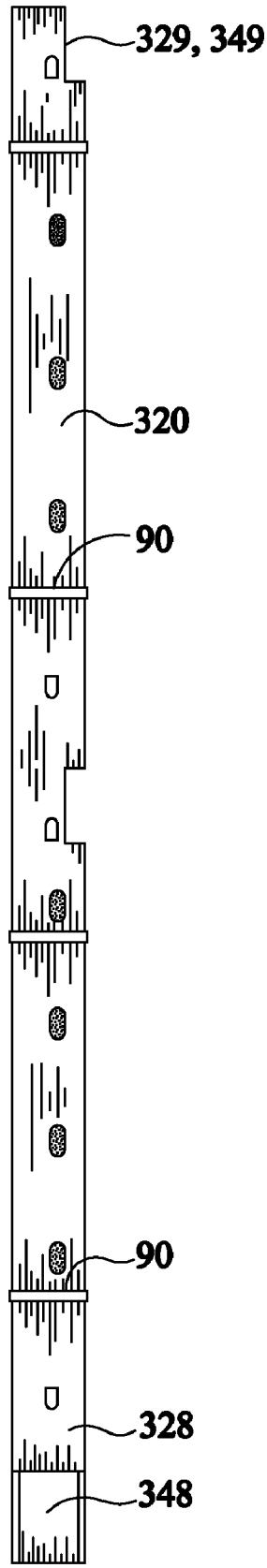
FIG. 22 is a side view of a two-floor-level insulated wall panel shown in FIG. 21.

FIGS. 21 and 22 show a front perspective view and a side view of wall panel 300, respectively. Wall panel 300 also has the same structure of the two-floor-level wall panel 100 described above, except that foot portions 328 and 348 of the first and second elongated studs 320 and 340 have a different or uneven length. As shown, foot portion 348 of the second elongated stud 340 is longer than foot portion 328 of the first elongated stud 320, typically from about 3.625 to about 16 inches, which results in uneven legs for the wall panel. The extended foot portion 348 is provided for securely assembling adjacent wall panels in construction of multiple floor levels, as described hereinafter. It is noted that in wall panel 300 top portions 326 and 346 of the first and second studs have a same height and the same structure as those described in wall panel 100.

Figure 23:
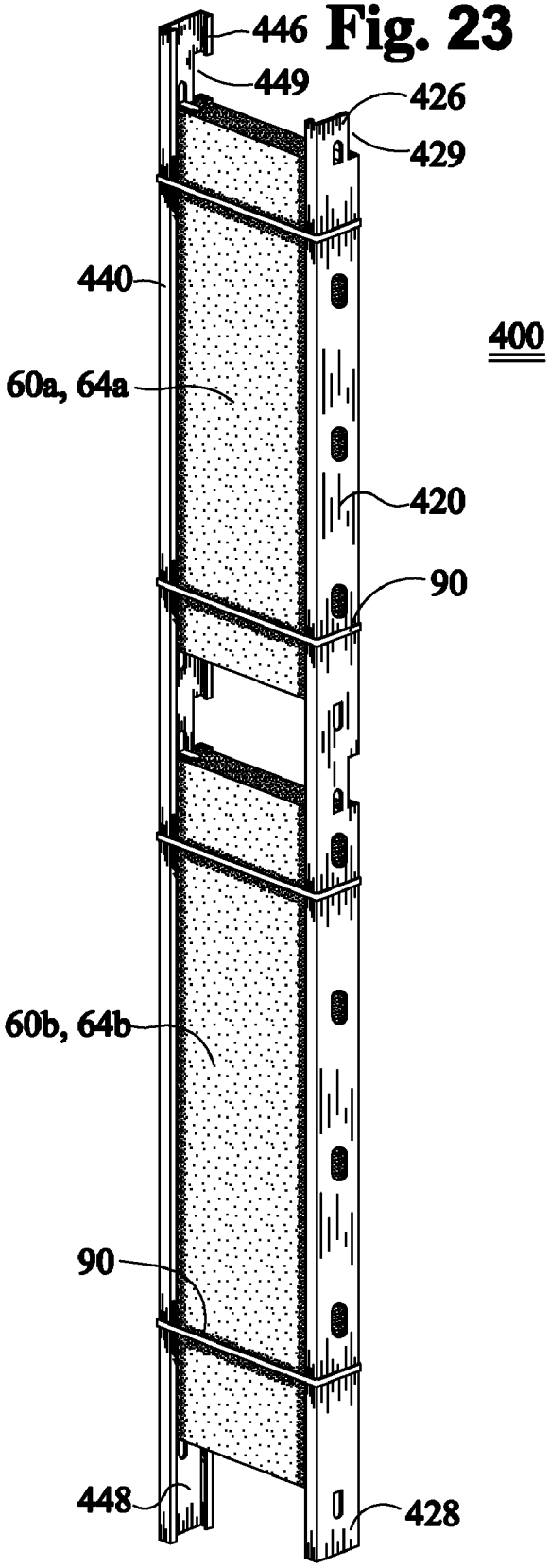
FIG. 23 is a front perspective view of a two-floor-level insulated wall panel in a yet another embodiment of the present invention, wherein the top portions of the elongated studs have an uneven length and the foot portions of the two elongated studs also have an uneven length.
Figure 24:
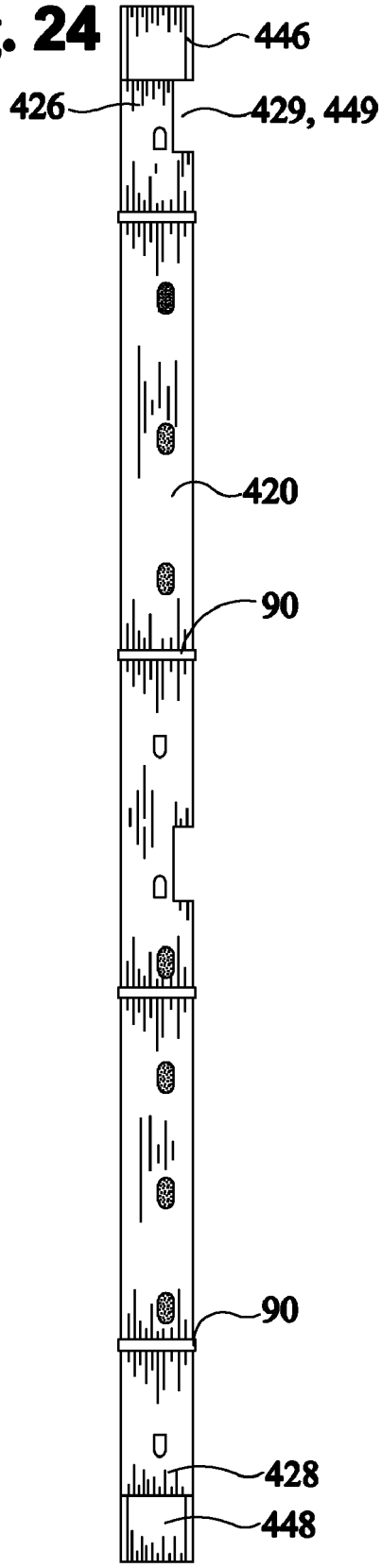
FIG. 24 is a side view of a two-floor-level insulated wall panel shown in FIG. 25.

FIGS. 23 and 24 show a front perspective view and a side view of wall panel 400, respectively. Wall panel 400 has the same structure of the two-floor-level wall panel 100 described above, except that top portions 426 and 446 of the first and second elongated studs 420 and 440 have a different or uneven height, and foot portions 428 and 448 of the first and second elongated studs 420 and 440 also have a different or uneven length. As shown, top portions 426 and 446 of the first and second elongated studs 420 and 440 have the same structures as those in wall panel 200 described above, and on the other hand, foot portions 428 and 448 have the same structures as those in wall panel 300 described above.

Figure 25:
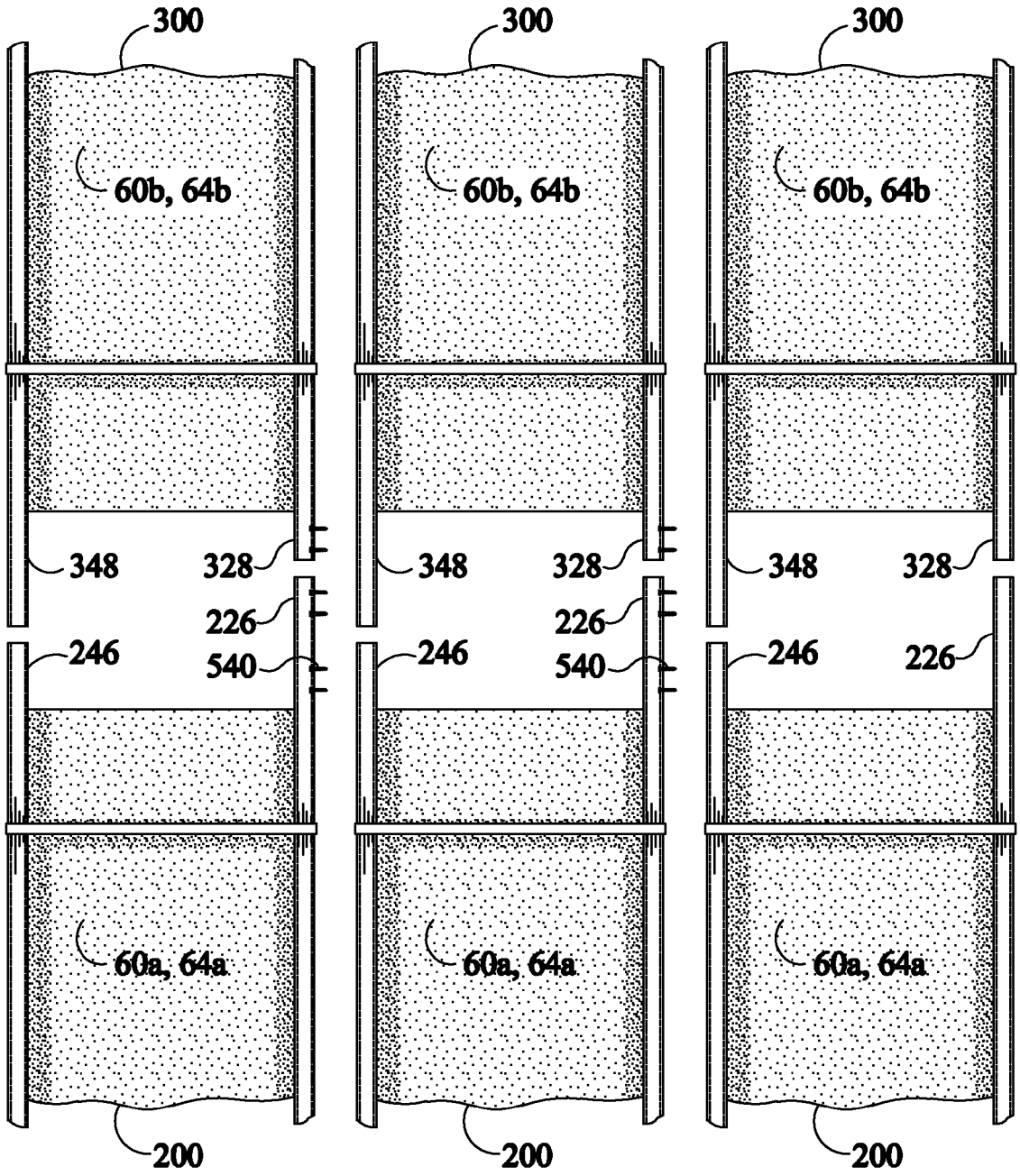
FIG. 25 is a partial exploded view showing a portion of a wall assembly made of six two-floor-level insulated wall panels shown in FIGS. 19 and 21.
Figure 26:
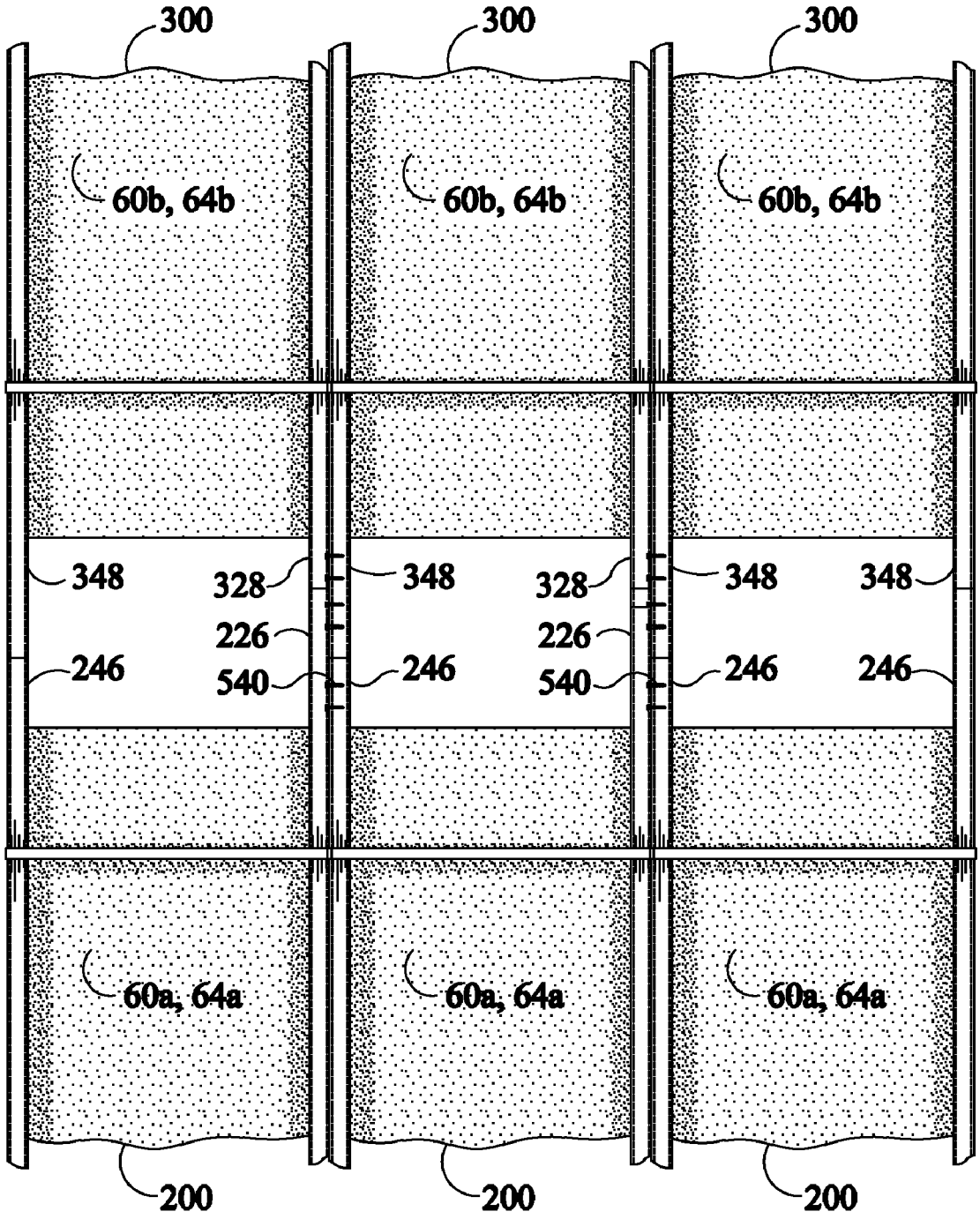
FIG. 26 is a view showing the six two-floor-level insulated wall panels of the wall assembly shown in FIG. 25 after the panels have been fastened together.
Figure 27:
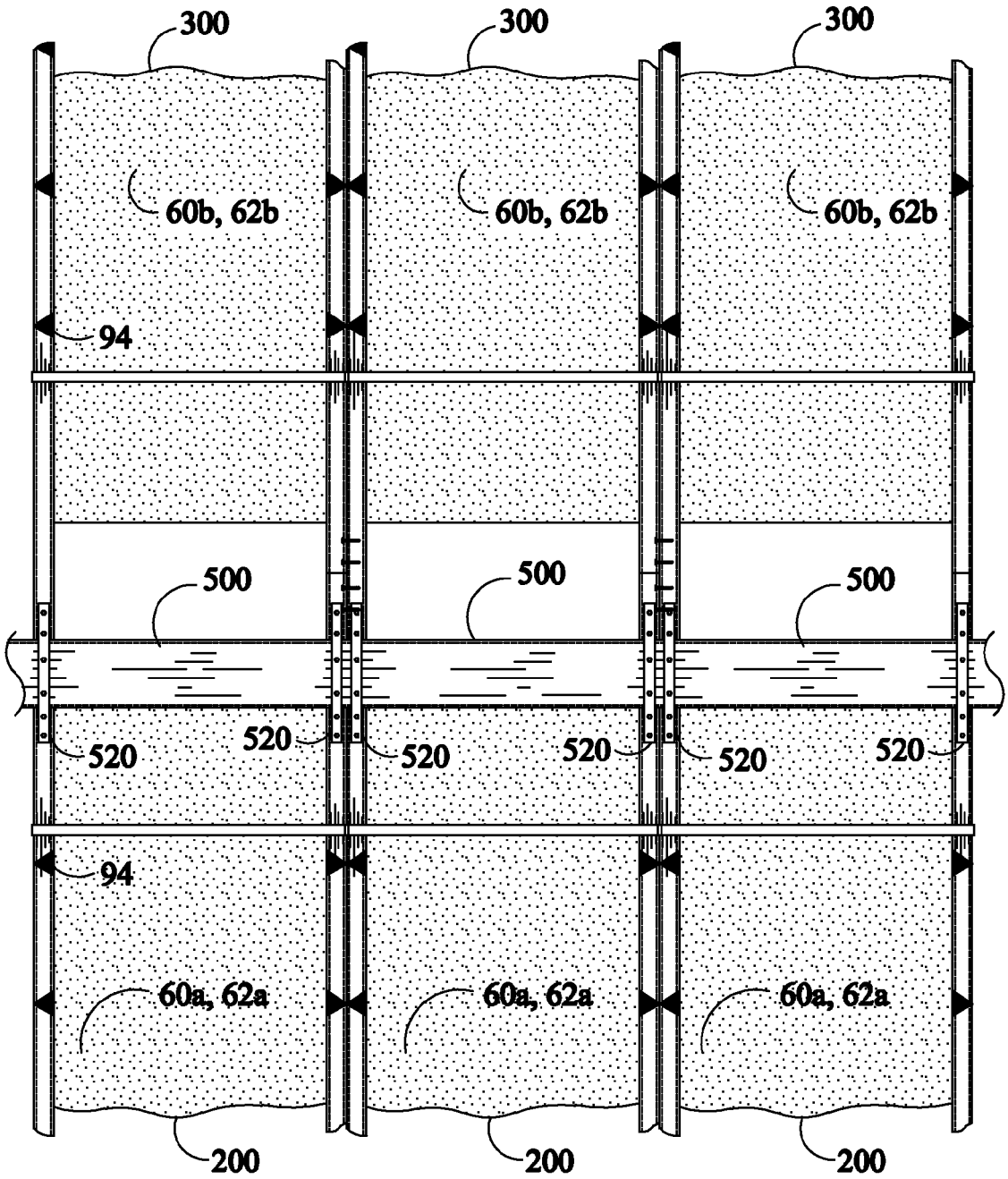
FIG. 27 further shows the portion of the wall assembly shown in FIG. 26 with a header beam inserted into and fastened to the formed notch rail.

FIGS. 25-27 illustrate how to assemble wall panels 200 and 300 in construction of walls in a four story building, which shows the lower portions of three wall panels 300 and upper portions of three wall panels 200. Wall panels 200 are for the first and second floors and wall panels 300 are for the third and fourth floors. In FIG. 25, wall panel 300 has foot portion 348 longer than foot portion 328, and wall panel 200 has top portion 226 higher than top portion 246 (reverse the structure shown in FIGS. 19 and 20). As shown, two adjacent wall panels are to be attached together by fastening means with the web sections of the studs against each other. Because of the uneven foot portions of wall panel 300 and uneven top portions of wall panel 200, top portion 226 can be affixed not only to top portion 246 of the next wall panel 200, it is also affixed to foot portion 348 of the next wall panel 300. Similarly, foot portion 348 can be affixed not only to foot portion 328 of the next wall panel 300, it is also affixed to top portion 226 of the next wall panel 200. In the embodiment shown, the wall panels are affixed together by multiple fastening means 540, such as screws, bolts, rivets, or other suitable means. As can be appreciated from FIG. 25 and 26, at the interface between two pairs of wall panels (each pair including a wall panel 300 on top of a wall panel 200), the lower ends of the foot portions of two immediate adjacent studs are at different height, which forms a staggered interface pattern through the wall panel assembly. This arrangement not only provides convenient attachment between adjacent panels, it also provides enhanced structural strength at the interfaces.

FIG. 27 further shows the interior side of the partial wall assembly shown in FIG. 26. As shown, the alignment markings on the inner flanges between two adjacent panels facilitate the alignment at any height. In FIG. 27, a header beam 500 is placed in the aligned top notches of wall panels 200 and fastened by sheet metal strips 520. The header beam 500 is used to support floor panels.

The wall panels having different top portions, different foot portions or both, in terms of length and structure are illustrated above using the two-floor-level wall panels. However, it should be understood that the same also applies to one-floor-level wall panel 10 described above. More specifically, the two studs of one-floor-level wall panels can have uneven top portions, uneven foot portions, or both.

In the wall panels of the present invention, the elongated studs can be made of any appropriate material, preferably made of metal, such as steel, plated or galvanized steel, aluminum, extruded metal such as aluminum alloy. Plated or galvanized steel is the material of choice, since the wall panels of the building structure must be capable of withstanding significant wind load, such as is typically encountered during thunderstorms, hurricanes, tornados and the like. The thickness or gauge of such materials may vary depending upon the size of the elongated studs, strength requirements of the buildings and engineer calculations. For example, typically the elongated studs used for two or more story buildings have greater thickness than those used for one story buildings. Typically, the elongated studs made of galvanized steel may have a thickness from about 25 to about 14 gauge, which is equivalent to from about 0.034 to about 0.0747 inches.

Similarly, the dimensions of the studs may vary depending upon the height of the walls, strength requirements, and the amount of insulating capacity desired. Typically, the elongated studs used for two or more story buildings have large dimensions than those used for one story buildings. The web section of the elongated stud made of galvanized steel may have a width from about 3.625 to about 12 inches, and the flange members has a width (in lateral direction of the wall panel) from about 1.625 to about 2.5 inches.

As can be appreciated, the height of the wall panels corresponds to the height of a wall to be constructed. For example, wall panel 10 has a height corresponding to the height of the walls of the one story building or a single floor, and wall panel 100 has an overall height equivalent to the height of the walls of the two story building, where the height from the bottom surface **68*a* of insulation board 60*a*** to the top end of the stud corresponds to the height of the walls of the second floor level, and the height from the foot portion of the studs to the lower end of the middle notch corresponds to the height of the walls of the first floor level. It is noted that the foot portion of the studs may be disposed above or within the foundation of the building, depending on the construction requirement. Moreover, some of the wall panels may be substantially shorter in height for placement of window frames or door frames of a building. Furthermore, for the wall panels to be placed between the top of a window frame or a door frame and the roof, the insulation board extends to the lower end of the foot portion of the elongated studs.

Figure 28:
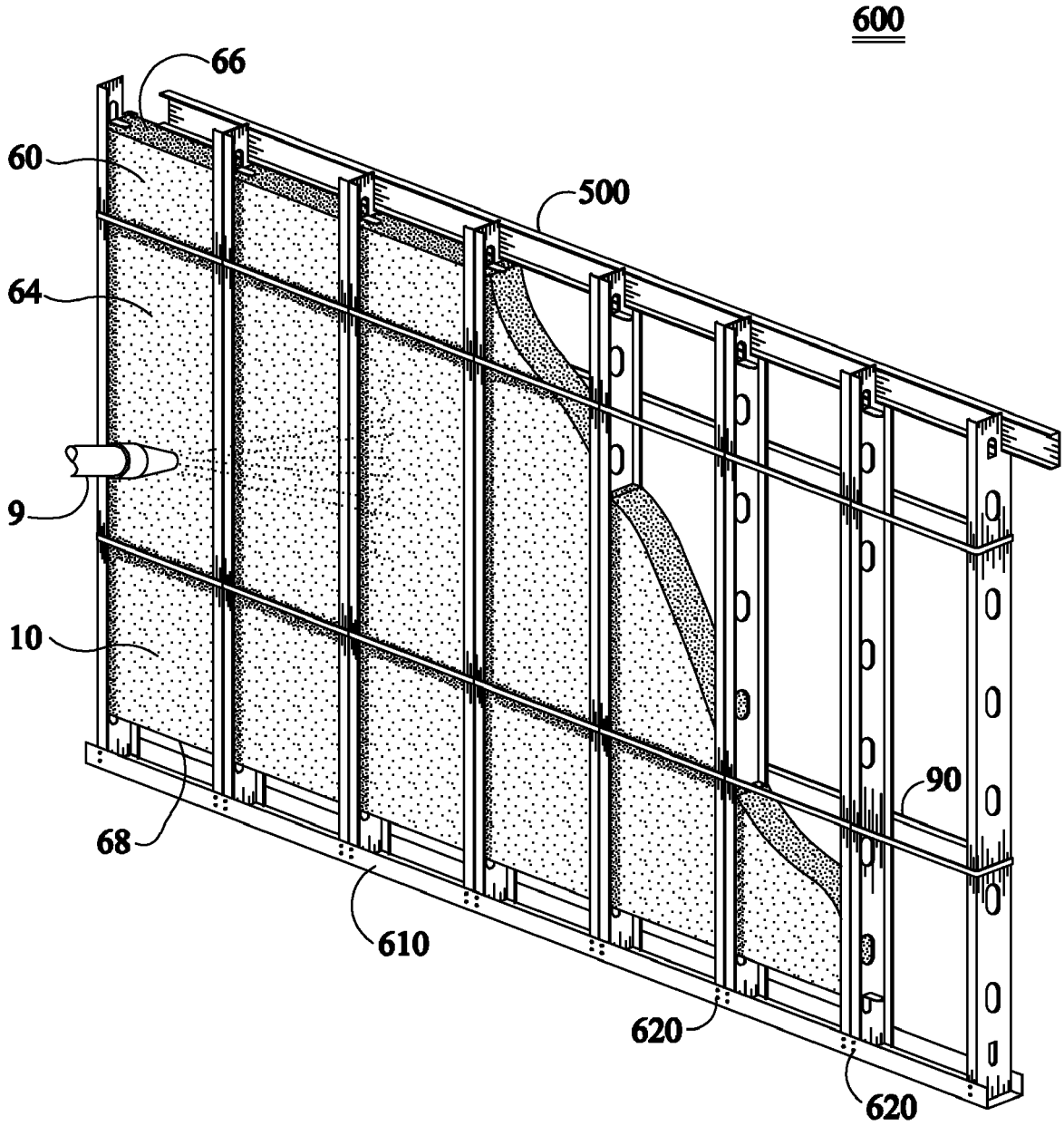
FIG. 28 is an illustrative view of a wall assembly for a one story building made of a plurality of the insulated wall panel 10 of the present invention shown in FIG. 1, showing the exterior side of the wall assembly, which further includes a header-beam for supporting the roof structure.
Figure 29:
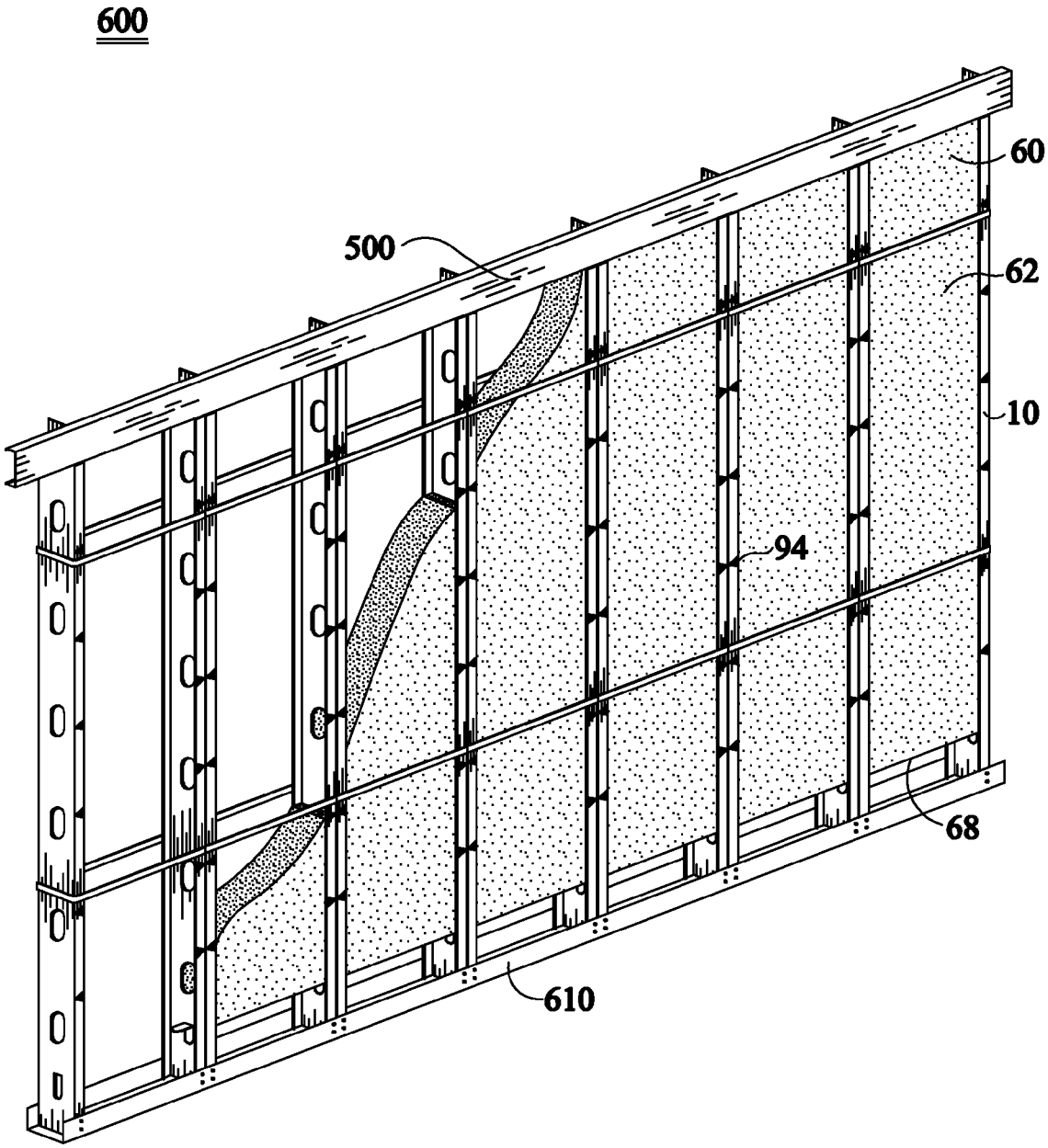
FIG. 29 is an illustrative view of the wall assembly shown in FIG. 28, showing the interior side of the wall assembly.

In a further aspect, the present invention provides a method of construction of a wall system using the prefabricated insulation wall panels. As illustrated in FIGS. 28-29, multiple wall panels 10 are assembled and fastened together to form a wall panel assembly 600 during construction of a single floor level. As shown, multiple wall panels 10 are aligned along the lateral direction of the wall panels one next to another with the adjacent web sections of the studs against each other. In the formed wall panel assembly 600, inner side of wall panels 10 faces the interior of the building, and the hollow spaces 80 on the outer side of the wall panels face the exterior of the building. In the embodiment shown, wall panels 10 are placed into a base track 610, and foot portions of the studs are affixed to track 610 by fastening means 620, such as screws, rivets, bolts, welding, bonding or other fastening means known in the art. However, it should be understood that the foot portions of the studs can also be directly integrated into the foundation of a building or attached to the foundation or a floor using any suitable means. As shown, in wall panel assembly 600 top notches 26 and 46 of the studs among all panels form an aligned notch trail, and a header beam 500 is placed in the notch trail, which is further secured to the studs by suitable fastening means (not shown). As illustrated in FIG. 28, after the wall panels are assembled and affixed to the foundation or floor, a temporary form work such as wood boards or aluminum form are placed on the exterior side of the wall panel assembly, with a predetermined distance to the outer flanges of the studs, or the outer surface 64 of insulation boards 60. Concrete can be sprayed through a hose 9, or poured into the hollow spaces 80 throughout the assembly and the space between the wall panels and the temporary form work, which produces a one floor level wall with an integral concrete layer. As can be appreciated, the concrete layer has an integral internal portion penetrated into and filled the space between the insulation board and the outer flanges of the studs of each wall panel and a continuous external portion throughout the assembly. This integral structure further joins all wall panels together. Typically, a metal mesh is placed against the outer side of the wall panels prior to pouring the concrete to further strengthen the concrete layer.

As can be appreciated, header beam 500 in the wall panel assembly 600 has multiple functions. Header beam 500 receives and supports a roof structure or a floor structure for a floor immediately above. On the other hand, when placed in the notch trail header beam 500 seals the space between the top surface 66 of insulation boards 60 and the top ends of the studs. As such, when concrete is poured, header beam 500 blocks the concrete from entering into the interior of the building. Moreover, when affixed on to all studs within the wall panel assembly, the header beam further enhances the structural strength of the assembly.

During the construction, preferably the wall panel assembly is so positioned that the upper end of the floor inside the building is at the same height as or slightly above the bottom surface 68 of insulation boards 60. As such, concrete enters the spaces between bottom surface 68 of insulation boards 60 and the lower ends of the studs, which joins the wall panel assembly, the interior floor structure and the exterior concrete layer of the wall all together.

As can be further appreciated in FIG. 29, which shows the interior side of the wall panel assembly, the alignment markings 94 become an indicator indicating the positions of through-holes 21 and 41 on the studs, which are no longer visible from either interior or exterior sides of the assembly.

Figure 30:
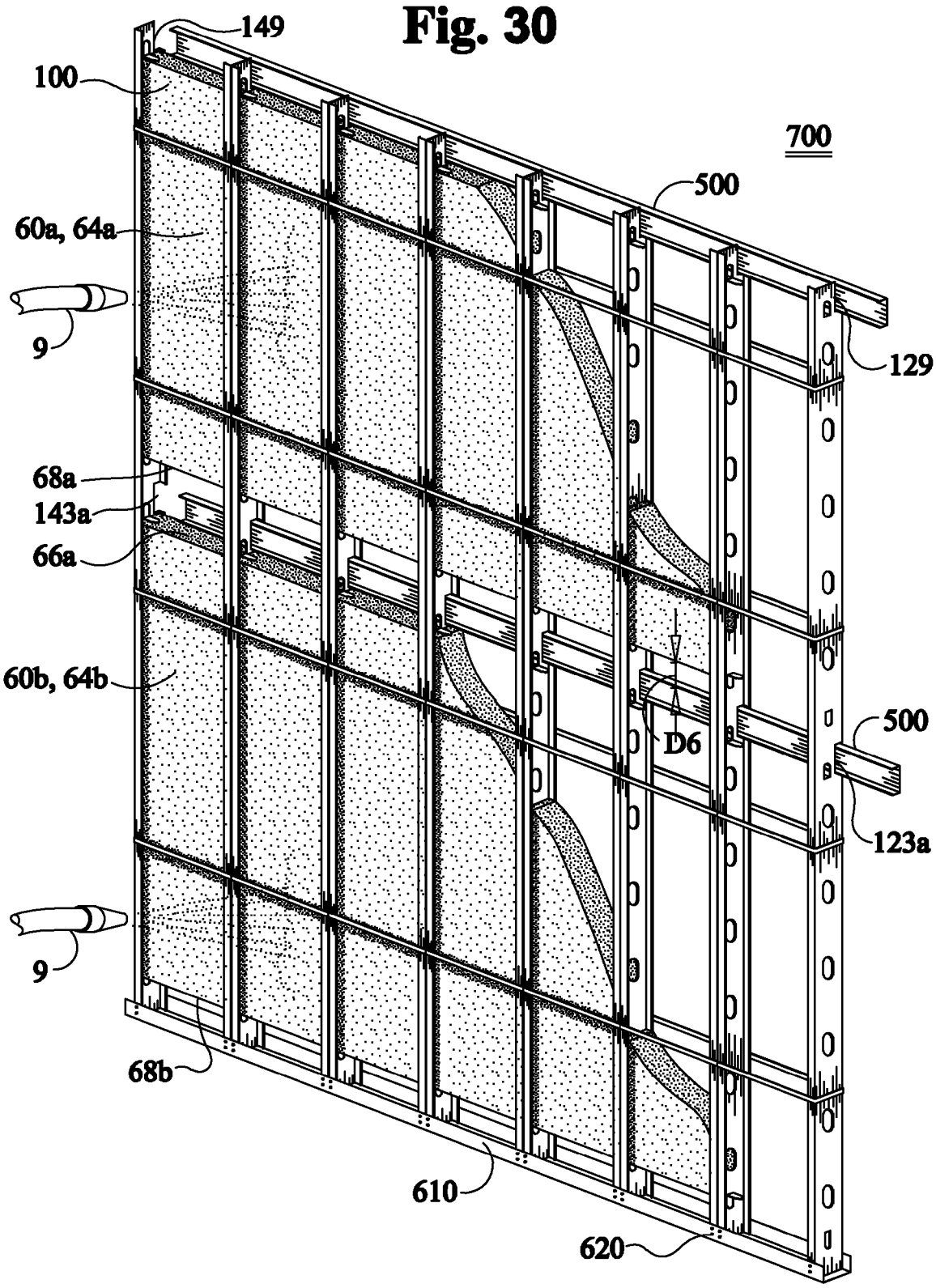
FIG. 30 is an illustrative view of a wall assembly for a two story building made of a plurality of the insulated wall panel 100 of the present invention shown in FIG. 10, showing the exterior side of the wall assembly, which further includes two header-beams for supporting the roof structure, and the floor panels for the second floor.
Figure 31:
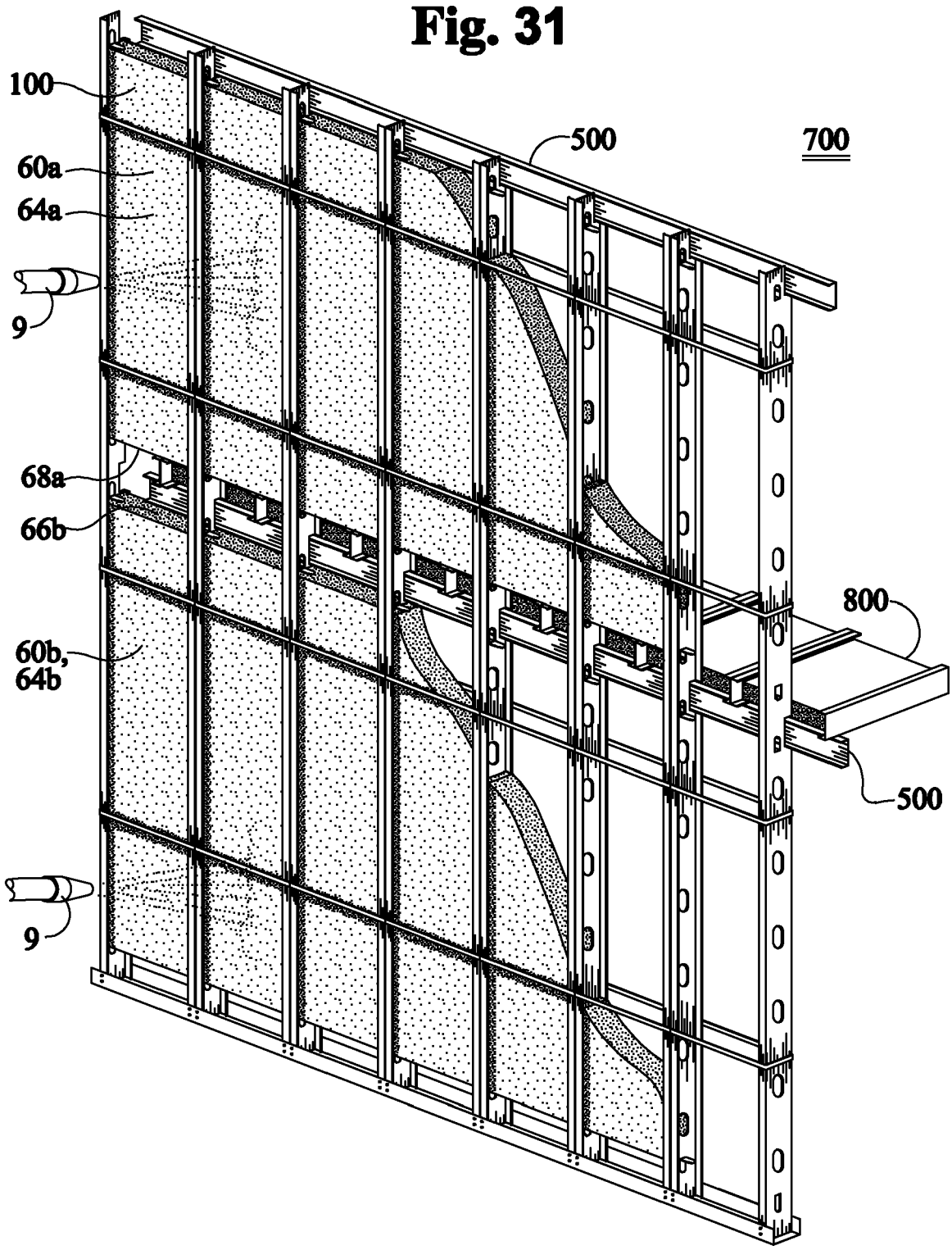
FIG. 31 is an illustrative view of the wall assembly shown in FIG. 30, showing a plurality of floor panels being placed on the second header beam.

FIGS. 30-31 further illustrate a two-floor-level wall panel assembly 700 formed by multiple two-floor-level wall panels 100 during construction of a wall of two floor levels. Assembling wall panel assembly 700 and construction of a two-floor-level wall using wall panels 100 are similar to those described above with wall panel assembly 600. In wall panel assembly 700, two header beams 500 are used. The first header beam 500 is placed in a top notch trail formed by top notches 129 and 149 of all wall panels, and fastened to the studs. The functions of the header beam have been described above. The second header beam 500 is placed in a middle notch trail formed by middle notches 123*a* and 143*a* of all panels, and fastened to the studs, such as in the manner shown in FIG. 27. The second header beam 500 has a similar function of the first header beam, and in this case, it provides a support to the floor structure of the second floor. As shown in FIG. 31, a plurality of floor panels 800 are placed on top of the second header beam 500. The floor panels 800 have a height similar to the distance D6 between the bottom surface 68*a* of insulation boards 60*a* and the upper end of middle notches 123*a* and 143*a* (see FIG. 18). As such, when concrete is poured in, concrete will fill in the space between the top surface 66*b* of insulation boards 60*b* and the bottom surface 68 of insulation boards 60*a* (as indicated by distance D5 in FIG. 18).

As described previously, two-floor-level wall panels 200, 300 and 400 are suitable for construction of walls of a building having two or more floor levels. For example, a combination of wall panels 200 and 300 can be used to construct a four story building using the same process shown with wall panel assembly 700, while with the interface connection between the wall panels shown above in FIGS. 25-27. Similarly, a combination of wall panels 200, 400 and 300 can be used to construct a six story building. Moreover, wall panels 200 and 300 can be used with one-floor-level wall panels that have uneven top or foot portions of the studs to construct buildings with odd number floor levels, such as three or five story buildings.

Figure 32:
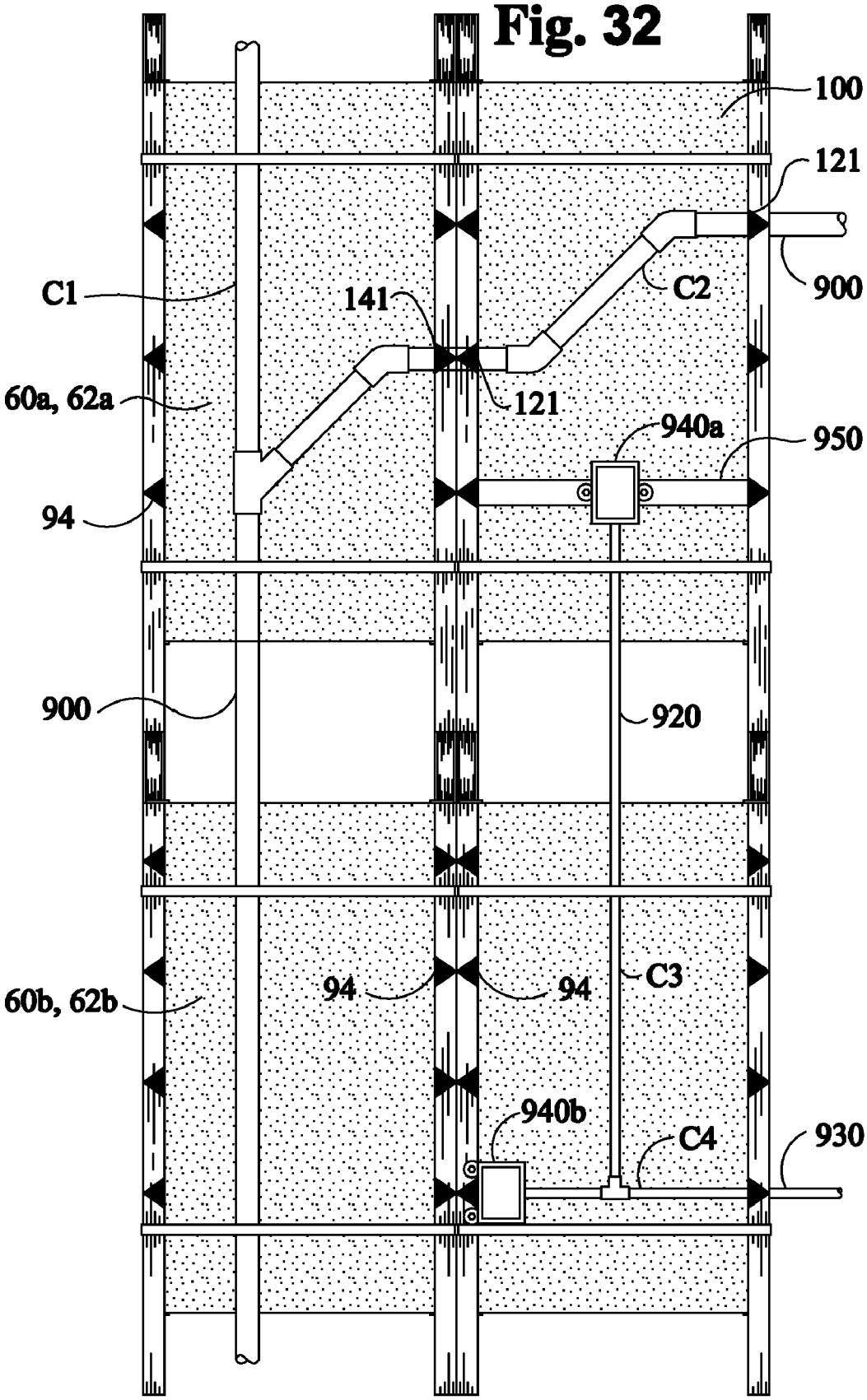
FIG. 32 illustrates the interior side of two insulated wall panels of the wall assembly shown in FIG. 30, showing alignment of the two wall panels and placement of pipes for electrical wires, socket and plumbing in the insulation boards of the wall panels as well as passing through the through-holes on the web section of the studs.

FIG. 32 illustrates placement of utilities such as electricity, telephone and television cable, electricity sockets, plumbing pipes into wall panel assembly 700, which can done either during construction of the buildings or as a part of prefabrication of the wall panels by the manufacturer. As shown, at the interior side of the wall panel assembly the alignment markings 94 on the inner flanges clearly indicate the position of through-holes 121 and 141 in each wall panel 100, which now are not visible. As stated above, insulation boards 60*a* and 60*b* are made of a material which is either heat deformable or can be cut by knife. Once the location of a specific utility is determined, construction workers can use a hot air blower or a knife to create one or more grooves or open channels (C1-C4) on the inner surface 62*a*, 62*b* of insulation boards 60*a*, 60*b* or both for placing the utility within the wall panel assembly. Once the groove is created, specific through-hoses 121 and 141 in the path of the groove are unobstructed and can be accessed from the interior side of the wall panel assembly.

In the example shown in FIG. 32, a plumbing pipe 900 and pipes 920 and 930 for electric wires are placed in insulation boards 60*a* and 60*b*, crossing horizontally between adjacent wall panels 100, as well as crossing from the lower floor level to the higher floor level. As further shown, housings 940*a* and 940*b* for electric sockets are also placed into insulation boards 60*a* and 60*b*, which can be either directly affixed to a stud of the wall panel (see 940*b*), or indirectly affixed to the studs of the wall panel through a strip 950.

As described above, the insulation board has a thickness sufficient to cover the through-holes on the web section of the studs when the insulation board is disposed against the inner flange. As such, when the walls are constructed, the insulation board prevents the concrete to enter or block the through-holes. Such a structural feature ensures that the through-holes are fully available for placement of utilities.

After the desired utilities are placed into the wall panel assembly, interior finish can be directly attached to the inner flanges of the studs of the wall panels using fastening means known in the art. All existing interior finish can be used, which include, but not limited to, stucco or plaster finish, gypsum board sheet, cloth panels, wood or metal sidings. This is substantially different from the conventional construction processes, where intermediate supports such as wood or metal strips need to be attached to the inside of the wall framing first, then the interior finish is attached on to the strips.

The wall panels and wall panel assembly of the present invention have many structural and functional advantages. As can be appreciated, the structural components of the instant wall panels are simple and the wall panels can be fabricated conveniently using available construction materials. The wall panels are versatile and can be used for construction of walls for single floor level, two floor levels, and more than two floor levels. The wall panels and wall panel assembly of the present invention can be used for construction of walls for residential, commercial and industrial buildings.

As a major advantage, using the two-floor-level wall panels of the present invention walls of more than one floor levels can be construction at the same time, which drastically increases construction speed and shortens construction schedule. As such, the multi-floor level wall panels of the present invention provide a revolutionary breakthrough in construction industry.

As can be appreciated, the wall panel assemblies of the present invention comprise a plurality of vertically orientated wall panels with a relatively narrow lateral width, which brings in a large number of metal studs within a wall panel assembly. Therefore, the assembly and the walls constructed therewith have a superior structural strength. Moreover, because of the unique unsymmetrical positioning of the insulation board against the inner flanges of the studs, the formed hollow space between the outer surface of the insulation board and the outer flanges of the studs permits integration of concrete of a constructed wall into the space within the wall panel. Such an integration of the wall panel assembly with the concrete layer further provides a strengthened structural integrity. The walls constructed using the wall panel assembly and the method of the present invention can withstand wind load of substantially high wind speed and earthquake.

As another major advantage, a significantly less amount of concrete can be used for constructing walls using the wall panels and wall panel assembly of the present invention. Currently, the thickness of the concrete walls constructed using the existing methods is typically about 4 inches for a one story building and about 6 inches for a two story building. It has been found surprisingly that using the wall panels and the method of the present invention as described above, the thickness of the concrete layer in the wall system can be about only 1.5 inches for a one story building and only about 3 inches for a two story up to five story building, while still meeting the requirements of construction standards and the building code. This substantially reduces the material cost of construction, because concrete is much more expensive than steel and insulation boards. For example, the material cost for construction of walls of a house can be reduced from about 30 to 40 percent using the wall panels and the method of the present invention than using the conventional methods.

Moreover, as stated above using the wall panels of the present invention interior finish can be directly attached to the inner flanges of the studs of the plurality of wall panels. Therefore, the immediate supports such as wood or metal strips can be eliminated in the construction. This further reduces construction time and cost.

On the other hand, the off-centered through-holes on the web section of the studs and the placement of insulation boards within the wall panel provide convenient access for arrangement of building utilities after the walls are constructed. Contrary to the existing prefabricated wall panels where the utility arrangement is typically limited to designated channels or fixtures of the panels, this unique structural feature of the wall panels of the present invention provides freedom and flexibility in utility arrangement. Furthermore, with the assistance of the unique alignment markings, the positions of the through-holes can be conveniently identified. These alignment markings also assist alignment of wall panels during construction, which enhances construction quality and speed.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A prefabricated insulation wall panel for construction of a concrete wall comprising:

(a) first and second elongated studs aligned in parallel and facing each other; each of said elongated studs comprising a planar web section and an inner flange and an outer flange integrally extending from said web section, and each of said elongated studs having a foot portion, a body portion and a top portion; said planar web section having multiple through-holes spaced apart in said body portion of said stud, said multiple through-holes being disposed off center in a transverse direction of said web section and closer to said inner flange than to said outer flange; and (b) one or more insulation board, each having inner and outer surfaces, top and bottom surfaces and two planar side edges and having a thickness less than a width of said web section of said stud; said one or more insulation board being disposed between said first and second elongated studs at said body portions thereof, having each of said side edges of said insulation board against an internal surface of said web section of said studs and covering said multiple through-holes, and having said inner surface of said one or more insulation board against said inner flanges of said studs, thereby establishing a distance between said outer surface of said one or more insulation board and said outer flange of each of said studs through said body portion of each of said studs.

2. The prefabricated insulation wall panel of claim 1 further comprising fastening means fastening said one or more insulation board and said elongated studs together.

3. The prefabricated insulation wall panel of claim 1, wherein each of said studs further comprises one or more pair of anchoring members protruding from said internal surface of said web section, and each of said one or more insulation board is disposed between said anchoring members.

4. The prefabricated insulation wall panel of claim 1 further comprising spacers disposed between said outer surface of said one or more insulation board and said outer flange of each of said studs to maintain said distance.

5. The prefabricated insulation wall panel of claim 1, wherein said distance between said outer surface of said one or more insulation board and said outer flange of said stud is from about ⅕ to about ½ of said width of said web section of said stud.

6. The prefabricated insulation wall panel of claim 1, wherein said multiple through-holes on said web section are aligned along a centerline of said through-holes, and said centerline is in parallel with a longitudinal axis of said stud and has a transverse distance to said inner flange shorter than a corresponding distance to said outer flange.

7. The prefabricated insulation wall panel of claim 1, wherein said top portion of each of said studs has a notch recessed from said inner flange.

8. The prefabricated insulation wall panel of claim 1, wherein said top portions of said first elongated stud and said second elongated stud of said wall panel have a different length.

9. The prefabricated insulation wall panel of claim 1, wherein said foot portions of said first elongated stud and said second elongated stud of said wall panel have a different length.

10. The prefabricated insulation wall panel of claim 1, wherein each of said elongated studs further comprises multiple alignment markings on said inner flange of said stud, disposed at same positions of said multiple through-holes in a longitudinal direction of said stud.

11. A prefabricated insulation wall panel for construction of a concrete wall comprising:

(a) first and second elongated studs aligned in parallel and facing each other; each of said elongated studs comprising a planar web section, and an inner flange and an outer flange integrally extending from said web section, and each of said elongated studs having a foot portion, an lower body portion, an upper body portion, a mid-portion between said upper body and lower body portions and a top portion; said planar web section having multiple through-holes spaced apart in said upper and lower body portions of said stud, said multiple through-holes being disposed off center in a transverse direction of said web section and closer to said inner flange than to said outer flange; and (b) first and second insulation boards, each thereof having inner and outer surfaces, top and bottom surfaces and two planar side edges and having a thickness less than a width of said web section of said stud; said first insulation board and said second insulation board disposed between said first and second elongated studs at said upper body and lower body portions of said studs, respectively, having each of said side edges of said insulation boards against an internal surface of said web section of said studs and covering said multiple through-holes, and having said inner surface of each of said insulation boards against said inner flanges of said studs, thereby establishing a distance between said outer surface of each of said insulation boards and said outer flange of each of said studs through said upper and lower body portions of said studs.

12. The prefabricated insulation wall panel of claim 11 further comprising fastening means fastening said insulation board and said elongated studs together.

13. The prefabricated insulation wall panel of claim 11, wherein each of said elongated studs further comprises a top notch in said top portion recessed from said inner flange, and a middle notch recessed from said inner flange in said mid-portion of said stud, immediately above said second insulation board.

14. The prefabricated insulation wall panel of claim 11, wherein each of said elongated studs further comprises two pairs of anchoring members protruding from said internal surface of said web section, and each of said insulation boards is disposed between one pair of said anchoring members.

15. The prefabricated insulation wall panel of claim 11 further comprising multiple spacers disposed between said outer surface of each of said insulation boards and said outer flange of each of said studs to maintain said distance.

16. The prefabricated insulation wall panel of claim 11, wherein said distance between said outer surface of each of said insulation boards and said outer flange of said stud is from about ⅕ to about ½ of said width of said web section of said stud.

17. The prefabricated insulation wall panel of claim 11, wherein said multiple through-holes on said web section are aligned along a centerline of said through-holes, and said centerline is in parallel with a longitudinal axis of said stud and has a transverse distance to said inner flange shorter than a corresponding distance to said outer flange.

18. The prefabricated insulation wall panel of claim 11, wherein said top portions of said first elongated stud and said second elongated stud of said wall panel have a same or a different length.

19. The prefabricated insulation wall panel of claim 11, wherein said foot portions of said first elongated stud and said second elongated stud of said wall panel have a same or a different length.

20. An insulated wall assembly comprising a plurality of prefabricated insulation wall panels, each thereof comprising:

(a) first and second elongated studs aligned in parallel and facing each other; each of said elongated studs comprising a planar web section, and an inner flange and an outer flange integrally extending from said web section, and each of said elongated studs having a foot portion, a body portion and a top portion; said planar web section having multiple through-holes spaced apart in said body portion of said stud, said multiple through-holes disposed off center in a transverse direction of said web section, having a distance to said inner flange shorter than a corresponding distance to said outer flange; and (b) one or more insulation board having inner and outer surfaces, top and bottom surfaces and two planar side edges and having a thickness less than a width of said web section of said stud; said one or more insulation board being disposed between said first and second elongated studs at said body portions thereof, having each of said side edges of said one or more insulation board against an internal surface of said web section of said studs and covering said multiple through-holes, and having said inner surface of said one or more insulation board against said inner flanges of said studs, thereby establishing a distance between said outer surface of said one or more insulation board and said outer flange of each of said studs through said body portions of said studs;

said plurality of prefabricated insulation wall panels being aligned one next to another, having said inner surface of said one or more insulation board facing an interior of a building structure and having said web sections of said elongated studs against each other, such that said multiple through-holes on said web section of each of said elongated studs among said plurality of wall panels are in alignment.

21. The insulated wall assembly of claim 20, wherein each of said elongated studs includes a notch recessed from said inner flange; and said wall assembly further comprises a header beam disposed in a notch trail formed by aligned notches through said assembly.

22. The insulated wall assembly of claim 21 further comprising a concrete layer having an integral internal portion thereof penetrated into and filled a space between said outer surface of said one or more insulation board and said outer flanges of said studs of each of said wall panels and a continuous external portion throughout said assembly.

23. The insulated wall assembly of claim 20, wherein each of said elongated studs of said wall panels further comprises multiple alignment markings on said inner flange of said stud, disposed at same positions of said multiple through-holes in a longitudinal direction of said stud, and said multiple alignment markings on adjacent wall panels are aligned with one another and function as indicators of positions of said multiple through-holes in said wall assembly.

24. An insulated wall assembly of two floor levels comprising a plurality of prefabricated insulation wall panels, each thereof comprising:

(a) first and second elongated studs aligned in parallel and facing each other; each of said elongated studs comprising a planar web section, and an inner flange and an outer flange integrally extending from said web section, and each of said elongated studs having a foot portion, an lower body portion, an upper body portion, a mid-portion between said upper body and lower body portions and a top portion; said planar web section having multiple through-holes spaced apart in said upper and lower body portions of said stud, said multiple through-holes being disposed off center in a transverse direction of said web section and closer to said inner flange than to said outer flange; and (b) first and second insulation boards, each thereof having inner and outer surfaces, top and bottom surfaces and two planar side edges and having a thickness less than a width of said web section of said stud; said first insulation board and said second insulation board disposed between said first and second elongated studs at said upper body and lower body portions of said studs, respectively, having each of said side edges of said insulation boards against an internal surface of said web section of said studs and covering said multiple through-holes, and having said inner surface of each of said insulation boards against said inner flanges of said studs, thereby establishing a distance between said outer surface of each of said insulation boards and said outer flange of each of said studs through said upper and lower body portions of said studs;

said plurality of prefabricated insulation wall panels being aligned one next to another, having said inner surface of said insulation board facing an interior of a building structure and having said web sections of said elongated studs against each other, such that said multiple through-holes on said web section of each of said elongated studs among said plurality of wall panels are in alignment.

25. The insulated wall assembly of claim 24, wherein each of said studs includes a top notch in said top portion recessed from said inner flange, and a middle notch recessed from said inner flange in said mid-portion of said stud; and said wall assembly further comprises a first header beam disposed in a top notch trail formed by aligned top notches and a second header beam disposed in a middle notch trail formed by aligned middle notches through said assembly.

* * * * *